US011752756B2

(12) United States Patent
Schwab

(10) Patent No.: US 11,752,756 B2
(45) Date of Patent: Sep. 12, 2023

(54) METHOD OF OPERATING A FLEXOGRAPHIC PRINTING PRESS, AND SYSTEM

(71) Applicant: Heidelberger Druckmaschinen AG, Heidelberg (DE)

(72) Inventor: Werner Schwab, Bechtsrieth (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 17/507,888

(22) Filed: Oct. 22, 2021

(65) Prior Publication Data

US 2022/0126561 A1 Apr. 28, 2022

(30) Foreign Application Priority Data

Oct. 22, 2020 (DE) ..... 102020213324.7

(51) Int. Cl.
*B41F 5/24* (2006.01)
*B41F 13/14* (2006.01)
(Continued)

(52) U.S. Cl.
CPC ..... *B41F 5/24* (2013.01); *B41F 13/14* (2013.01); *B41F 13/24* (2013.01); *B41F 33/0081* (2013.01)

(58) Field of Classification Search
CPC .. B41F 5/24; B41F 13/14; B41F 13/24; B41F 33/0081; B41F 13/08; B41F 13/34;
(Continued)

(56) References Cited

U.S. PATENT DOCUMENTS 4,553,478 A 11/1985 Greiner et al.
5,855,739 A 1/1999 Ampulski et al.
(Continued)

FOREIGN PATENT DOCUMENTS

CN 102381013 A 3/2012
DE 3302798 A1 8/1984
(Continued)

*Primary Examiner* — Matthew G Marini
*Assistant Examiner* — Leo T Hinze
(74) *Attorney, Agent, or Firm* — Laurence A. Greenberg; Werner H. Stemer; Ralph E. Locher

(57) ABSTRACT

A method of operating a flexographic printing press having a printing cylinder carrying a sleeve with at least one flexographic printing forme or a flexographic printing cylinder, and an impression cylinder, includes adjusting contact pressure between the printing cylinder or the flexographic printing cylinder and the impression cylinder by motor. The adjustment is made in an automated way as a function of a dot density of the flexographic printing forme, i.e. of a location-dependent density of printing elevations on the flexographic printing forme or data computationally derived therefrom. A cost-efficient way of producing high-quality prints in an industrial flexographic printing process is thus provided. In addition, the method advantageously provides further automation of the printing process. A flexographic printing press, a flexographic printing press system, and a flexographic printing forme or sleeve for a flexographic printing forme are also provided.

16 Claims, 12 Drawing Sheets

(51) Int. Cl.
*B41F 13/24* (2006.01)
*B41F 33/00* (2006.01)

(58) Field of Classification Search
CPC .. B41F 33/0027; B41F 33/0072; B41F 33/14; B41F 13/12; B41F 23/04; B41F 33/0009; B41F 33/0036; B41P 2200/12
See application file for complete search history.

(56) References Cited

U.S. PATENT DOCUMENTS

| | | | | |
|---|---|---|---|---|
| 8,534,194 | B2 | 9/2013 | Whitelaw et al. | |
| 10,632,737 | B2 | 4/2020 | Billing et al. | |
| 2010/0011978 | A1 | 1/2010 | Whitelaw et al. | |
| 2010/0018419 | A1* | 1/2010 | Whitelaw | B41F 13/38 101/248 |
| 2014/0251169 | A1* | 9/2014 | Loddenkoetter | B41F 31/30 101/483 |
| 2017/0165956 | A1 | 6/2017 | Becker | |
| 2019/0016111 | A1* | 1/2019 | Schwab | B41F 3/12 |
| 2019/0351688 | A1* | 11/2019 | Sievers | B41M 1/04 |
| 2020/0353742 | A1 | 11/2020 | Schwab | |

FOREIGN PATENT DOCUMENTS

| | | | |
|---|---|---|---|
| DE | 19949951 | A1 | 5/2001 |
| DE | 102006060464 | A1 | 7/2008 |
| DE | 202007004717 | U1 | 9/2008 |
| DE | 102014215648 | A1 | 2/2016 |
| DE | 102018202282 | A1 | 8/2019 |
| DE | 102020111341 | A1 | 11/2020 |
| EP | 3251850 | A1 | 12/2017 |
| WO | 2008049510 | A1 | 5/2008 |
| WO | 2010146040 | A1 | 12/2010 |

* cited by examiner

METHOD OF OPERATING A FLEXOGRAPHIC PRINTING PRESS, AND SYSTEM

CROSS-REFERENCE TO RELATED APPLICATION

This application claims the priority, under 35 U.S.C. § 119, of German Patent Application DE 10 2020 213 324.7, filed Oct. 22, 2020; the prior application is herewith incorporated by reference in its entirety.

FIELD AND BACKGROUND OF THE INVENTION

The invention relates to a method of operating a flexographic printing press, in which the flexographic printing press includes a printing cylinder carrying a sleeve with at least one flexographic printing forme or a flexographic printing cylinder and an impression cylinder, and a motor for adjusting contact pressure between the printing cylinder or the flexographic printing cylinder and the impression cylinder.

The invention further relates to a flexographic printing press which is operated in accordance with a method of the invention to print on a printing substrate using flexographic printing ink and which has at least one flexographic printing unit, the flexographic printing unit including a printing cylinder carrying a sleeve with at least one flexographic printing forme or a flexographic printing cylinder, an impression cylinder, and an anilox roller, and the flexographic printing press is operated in accordance with one of the methods recited above to print on a printing substrate using flexographic printing ink.

The invention further relates to a system formed of a flexographic printing press of the invention and a measuring device for measuring the dot density of the flexographic printing forme.

The invention further relates to a flexographic printing forme or a sleeve for use in a method of the invention or for use in a flexographic printing press of the invention or for use in a system of the invention, the flexographic printing forme or sleeve being being marked width a machine-readable ID.

The technical field of the invention is the field of the graphic industry, in particular the field of operating a flexographic printing press, i.e. a rotary printing press which uses flexographic printing formes to print. In particular, the technical field of the invention is the field of controlling the press and the drives and/or actuating drives thereof to increase print quality and the productivity of the press and/or to avoid or reduce disturbances.

A requirement in so-called flexographic printing, in particular industrial, web-fed flexographic printing, is to print in a cost-efficient way at high speeds with as little waste as possible while maintaining a high quality and using different flexographic printing formes for every print job.

In this context, changing print jobs with different printing formes and different prints may cause problems: the images to be printed may include areas where a lot is printed and areas where only a little is printed as well as areas where nothing or hardly anything is printed.

In general, sleeves are not equipped with flexographic printing plates (mounting) until shortly before printing starts.

In flexographic printing, the press stage and the prepress stage are much less closely linked than in offest printing, for instance: JDF or XJDF have not been established as an interface between prepress and press. This means that the print shop usually does not have any prepress data. In many cases, the prepress stage, in particular the platesetting process to create the flexographic printing formes, even takes place at a different shop.

Before the printing operation, flexographic printing plates may be measured, for instance in a measuring station. A later-published German Patent Application DE 10 2020 111 341A1, corresponding to U.S. Patent Application Publication No. 2020/0353742, discloses a device for measuring elevations on the surface of a rotary body and provides an improvement which in particular provides a way of quickly measuring elevations of rotary bodies such as flexographic print dots on a flexographic printing plate with a great degree of accuracy. The disclosed device for measuring elevations on the surface of a rotary body embodied as a cylinder, roller, sleeve, or plate of a printing press, e.g. a flexographic printing plate mounted to a sleeve, has a first motor for rotating the rotary body about an axis of rotation and a measuring device and is distinguished by the measuring device including a radiation source and at least one area scan camera for taking contact-free measurements.

Further documents: German Patent Application DE 33 02 798 A1, corresponding to U.S. Pat. No. 4,553,478; German Patent Application DE 10 2014 215 648 A1; European Patent Application EP 3 251 850 A1; German Patent Application DE 10 2006 060 464 A1, corresponding to U.S. Pat. No. 8,534,194; International Publication WO2010/146040 A1; and International Publication WO2008/049510 A1, which are cited and described in the aforementioned document, and the "smartGPS®" system manufactured by the Bobst Company and described therein are also part of the prior art, as is the "ARun" system of the Allstein Company.

German Utility Model DE 20 2007 004 717 U1, corresponding to U.S. Pat. No. 8,534,194, discloses a rotary printing press with a number of color decks, at least one of which includes a roller and an adjustment system for adjusting the position of the roller relative to at least one other component of the printing press, wherein the at least one color deck includes a control unit equipped to receive and process data about the roller, that data describing the topography of the surface of that specific roller and/or the spatial relationship between a print pattern and a reference mark formed on the roller, and wherein the control unit is further equipped to actuate the adjustment system in accordance with the adjustment data to adjust the roller to an optimum position to print without any or at least with a reduced number of unusable prints. The roller to be adjusted may for instance be a printing cylinder or a printing cylinder sleeve in a flexographic printing press or an anilox roller in a flexographic printing press. The adjustment data obtained in the scanning step and written on the RFID tag may be raw data such as data which specify the average image density of the image to be printed (e.g. the ratio between the printing and non-printing parts of the print pattern, averaged over a suitable portion of the roller surface).

SUMMARY OF THE INVENTION

It is accordingly an object of the invention to provide a method of operating a flexographic printing press, a flexographic printing press, a flexographic printing press system and a flexographic printing forme or sleeve for a flexographic printing forme, which overcome the hereinaforementioned disadvantages of the heretofore-known methods, printing presses, systems and formes of this general type and which, in particular, provide a cost-efficient way of producing high-quality prints in an industrial flexographic printing operation.

With the foregoing and other objects in view there is provided, in accordance with the invention, a method of operating a flexographic printing press, which comprises providing the flexographic printing press with a printing cylinder carrying a sleeve with at least one flexographic printing forme or a flexographic printing cylinder, an impression cylinder, and a motor for adjusting the contact pressure between the printing cylinder or the flexographic printing cylinder and the impression cylinder, in which the adjustment is made in an automated way as a function of a dot density of the flexographic printing forme, i.e. of a location-dependent density of printing elevations on the flexographic printing forme, or data computationally derived therefrom.

With the objects of the invention in view, there is also provided a flexographic printing press comprising at least one flexographic printing unit, the flexographic printing unit including a printing cylinder carrying a sleeve with at least one flexographic printing forme or a flexographic printing cylinder, an impression cylinder, and an anilox roller, and the flexographic printing press being operated in accordance with the method recited above to print on a printing substrate using flexographic printing ink, in which the flexographic printing press further includes at least one actuating motor for an automated adjustment of the contact pressure between the printing cylinder or flexographic printing cylinder and the impression cylinder.

With the objects of the invention in view, there is furthermore provided a system formed of a flexographic printing press of the invention and a measuring device for measuring the dot density of the flexographic printing forme in which the measuring device measures the dot density of the flexographic printing forme and transmits the dot density or data derived therefrom to the flexographic printing press.

With the objects of the invention in view, there is concomitantly provided a flexographic printing forme or a sleeve for a flexographic printing forme for use in a method or in a flexographic printing press or in a system, the flexographic printing forme or sleeve being marked with a machine-readable ID, and the machine-readable ID being read out by a machine and saved on a computer to be accessed.

Advantageous Embodiments and Effects of the Invention

The invention advantageously provides a cost-efficient way of producing high-quality prints in an industrial flexographic printing process. In addition, the method of the invention advantageously provides further automation of the printing process.

The invention is described in the context of flexographic printing presses and flexographic printing formes (relief printing). Alternatively, the invention may be used for engraved printing formes or engraved sleeves (gravure). Thus in the context of the present invention, "gravure" or "flexographic or gravure" may be used as alternatives to "flexographic". Instead of "sleeve with a flexographic printing forme," the expression "sleeve with an engraved printing forme" or "engraved sleeve" or "laser-engraved sleeve" or "endless laser-engraved sleeve" or "endless printing forme" or "endless printing sleeve" may be used.

Further Developments of the Invention

The following paragraphs describe preferred further developments of the invention (in short: further developments).

A respective further development of the method of the invention may be distinguished in that:

- adjustments during the printing operation occur dynamically, i.e. as a function of the rotary speed of the printing cylinder.
- the dot density of the flexographic printing forme is measured.
- the dot density of the flexographic printing forme is measured in a contact-free way.
- the dot density of the flexographic printing forme is measured by measures other than follower rolls.
- the dot density of the flexographic printing forme is measured before the printing operation.
- the dot density of the flexographic printing forme is measured in a measuring device before the printing operation.
- the measuring device includes a receptor cylinder for receiving the flexographic printing forme or a sleeve carrying the flexographic printing forme,
- the receptor cylinder rotates about an axis of rotation—which has an axial direction—during the measurement.
- the measuring device is operated outside the flexographic printing press.
- a camera is used in the measuring process.
- an area scan camera (2D image camera) is used in the measuring process.
- a line scan camera (1D image camera) is used in the measuring process.
- at least one CIS sensor is used in the camera.
- a stationary camera is used in the measuring process.
- the camera is moved in a direction perpendicular to the axial direction before the measuring operation.
- the camera is moved in an axial direction during the measuring operation.
- a radiation source, in particular a light source, is used in the measuring operation carried out by the camera.
- an entire image of a flexographic printing forme is scanned in the measuring operation.
- at least one or at least two flexographic printing forme/s is/are mounted to a sleeve and scanned in the measuring operation.
- the entire sleeve, i.e. the circumferential surface thereof equipped with flexographic printing formes is scanned in the measuring operation.
- in the measuring operation, light from a light source gets to elevations of the flexographic printing forme and from there to the camera.
- in the measuring operation by using the camera, at least one mirror is used.
- the mirror is disposed to be movable.
- that before the measuring operation, the mirror is moved in a direction perpendicular to the axial direction.
- during the measuring operation, the mirror is moved in an axial direction.
- in the measuring operation, light from a light source gets to elevations of the flexographic printing unit and from there back to the camera through the mirror.
- in the measuring operation, a laser and a triangulation measurement operation are used.
- the dot density is computationally determined from prepress data for creating the flexographic printing forme.
- a calculation of adjustment values is made.

the adjustment values are transmitted to a control unit of the motor for adjusting the contact pressure/printing pressure.

the calculation of the adjustment values is made as a function of a dot density of the flexographic printing forme, i.e. of a location-dependent density of printing elevations of the flexographic printing forme or of data computationally derived therefrom.

a computer, i.e. a digital computer, is used to make the calculation of the adjustment values.

the dot density or the data derived therefrom is transmitted to the computer.

the calculation of the adjustment values involves an averaging across defined surface sections of the flexographic printing forme.

the calculation of the adjustment values involves a division into categories.

the calculation of the adjustment values involves the generation of a density-categories vector.

an n-dimensional vector with the following n categories is created: 0%, 0-5%, 5-10%, 90-95%, 95-100% or 0%, 0-10%, 80-90%, 90-100% where 100% corresponds to a solid area.

the calculation of the adjustment values includes two calculations and a separate calculation of an adjustment value is made for every axial side.

the calculation of the adjustment values involves the creation of two density-categories vectors.

the adjustment values are transmitted to a control unit of a motor for adjusting the contact pressure/printing pressure, wherein the contact pressure/printing pressure is changed in steps of 0.01 mm as a function of the transport speed of a web of printing material.

the calculation of the adjustment values is additionally made as a function of a predefined or measured shore hardness of the flexographic printing forme or of data computationally derived therefrom.

the adjustment values are transmitted to a control unit of at least one motor for adjusting the contact pressure, wherein the contact pressure is changed as a function of the shore hard ness. Preferably two motors are present (on DS and OS).

the flexographic printing forme includes an anilox roller for inking the flexographic printing forme.

the anilox roller is marked with an ID and the ID is identified in the flexographic printing press.

the anilox roller is marked with an ID and the ID carries information on the transfer volume as well as for example on the geometry, lines per inch, line width, and/or depth of the cells and their angulation.

the anilox roller is marked with an ID and information associated with this ID such as transfer volume, geometry, lines per inch, line width, and/or depth of the cells and their angulation is saved in a data memory or a cloud memory.

a further contact pressure, i.e. a contact pressure between the printing cylinder and the screen roller is adjusted by motor.

the adjustment of the further contact pressure is done dynamically during the printing operation, i.e. as a function of the rotary speed of the printing cylinder.

for the adjustment of the further contact pressure a calculation of further adjustment values is made.

the adjustment values and/or the further adjustment values are transmitted to a control unit of the motor and/or of a further motor for adjusting the further contact pressure.

the calculation of the further adjustment values factors in the dot density of the flexographic printing forme, i.e. the location-dependent density of elevations for printing formed in the flexographic printing forme.

a calculated target value of the further adjustment value of the contact pressure is compared to a determined actual value of the adjustment value of the contact pressure during an undisturbed printing operation and a deviation of the target value from the actual value is computationally determined on the basis of the comparison and a correction value is computationally determined.

when printing with different flexographic printing formes of a number of flexographic printing formes, different correction values are determined and saved.

an AI goes through computational learning steps with the saved correction values and before a printing operation with a further flexographic printing forme—which is different from the number of flexographic printing formes the AI determines a correction value for the flexographic printing forme and this correction value is used in the printing operation.

the sleeve and/or of one or more mounted flexographic printing formes are subjected to a computational quality control.

an AI is subjected to a learning process to learn automatically to recognize dot density of printing formes such as flexographic printing formes for subsequent operations. At least one (teach-in) printing forme may be created to teach in the AI. The printing forme may include at least one (teach-in) print image with various dot densities to be taught, in particular in steps (e.g. 0%, 5%, 10%, . . . , 100%) or continuously (e.g. 0 to 100%). Such a printing forme/the print image thereof may be recorded by a camera, and the AI may use the recorded digital image to learn, preferably under human/machine guidance, to identify areas on the print image that correspond to specific dot densities and to mark the associated area in the digital image in a corresponding way. The KI is preferably taught/trained using many and different (teach-in) print images and additionally, if necessary or desired, using real print images. This process increases the accuracy at which the AI recognizes dot densities. When the AI has attained the required degree of recognition accuracy, the teaching process may be terminated. An AI that has been trained in this way will then be able quickly to recognize areas of specific dot densities with great accuracy and to mark them in a corresponding way in the digital image of an actual printing forme. Such an AI may then be used in the context of the invention to recognize dot densities.

A respective further development of the flexographic printing press of the invention may be distinguished in that:

using the dot density or data derived therefrom, the actuating motor is computationally controlled (potentially in a closed control loop) in such a way that the contact pressure/printing pressure between the printing cylinder and the impression cylinder has a predefined value or a predefined value range.

the flexographic printing press includes a dryer for drying the printing substrate and/or the flexographic printing ink.

the dryer is a hot-air dryer.

the dryer is an IR dryer.

the dryer is a UV dryer.

the dryer includes a dryer control unit.

the dryer includes a device for adjusting or controlling (potentially in a closed control loop) the power of the dryer.

the power of the dryer is changeable based on a computational use of the dot density or data derived therefrom.

the power of the dryer is changeable additionally based on a computational use of the transfer volume of the anilox roller.

the power of the dryer is changeable additionally based on a computational use of the value of the solid-body content or water content of the flexographic printing ink.

the calculation of the amount of water transferred to the printing substrate factors in the transferred amount of ink.

the dryer includes a device for adjusting or controlling (potentially in a closed control loop) the moisture in the dryer.

the device includes an adjustable or controllable flap which influences the amount of preheated air introduced into the dryer.

the device includes an adjustable or controllable flap which influences the amount of damp exhaust air removed from the dryer.

the dryer includes a connection through which damp exhaust air from the dryer is admixed to the preheated air introduced into the dryer.

the amount of inlet air and the amount of exhaust air are reduced.

the amount of air circulating through the connection is increased.

when the flexographic printing press is in operation, it prints on cardboard.

the cardboard is a cardboard that absorbs water from the flexographic printing ink.

the cardboard is coated, for instance with polyethylene.

the sleeve carries at least two flexographic printing formes with different images to be printed.

the two flexographic printing formes are mounted to the sleeve so as to follow one another in the circumferential direction or so as to follow one another in the axial direction.

A respective further development of the system of the invention may be distinguished in that:

The measuring device is part of a measuring station which is separate from the flexographic printing press.

the flexographic printing forme and/or the sleeve is marked with a machine-readable ID.

the ID is an unambiguous identifier of the sleeve.

the identifier includes multiple symbols, in particular digits and/or letters special characters.

the ID is marked as a one-dimensional code, in particular a bar code, or as a two-dimensional code, in particular a QR code, or as a RFID chip or NFC chip.

the measuring device transmits the dot density or data derived therefrom directly to the flexographic printing press together with the ID.

the measuring device indirectly transmits the dot density or data derived therefrom to the flexographic printing press together with the ID in that the dot density or the data derived therefrom is buffered and accessed by the flexographic printing press for a printing operation with the flexographic printing forme and/or the sleeve.

the buffering is done on a central memory or a cloud memory.

the measuring device measures a shore hardness of the flexographic printing forme and transmits the shore hardness or data derived therefrom to the flexographic printing press.

to measure the shore hardness, a measuring stamp is placed on the flexographic printing forme or on a measuring field of the flexographic printing forme.

the system includes a plurality of anilox rollers of different screens and/or screen rulings and/or screen angles and that in a printing operation with a flexographic printing forme, the flexographic printing press is operated with an anilox roller which has been computationally selected from among the plurality of anilox rollers on the basis of the dot density of the flexographic printing forme or data derived therefrom.

that the selected screen roller has a screen that is finer than the screen of the flexographic printing forme.

A respective further development of the flexographic printing forme of the invention or sleeve of the invention for a flexographic printing forme may be distinguished in that:

the mark with the machine-readable ID is made using a marking device different from an RFID chip.

the flexographic printing forme includes a measuring field for measuring the shore hardness.

Any desired combination of the features and combinations of features disclosed in the above sections on the technical field, invention, and further developments as well as in the section below on exemplary embodiments likewise represents advantageous further developments of the invention.

Other features which are considered as characteristic for the invention are set forth in the appended claims.

Although the invention is illustrated and described herein as embodied in a method of operating a flexographic printing press, a flexographic printing press, a system and a flexographic printing forme or sleeve for a flexographic printing forme, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures, corresponding features have the same reference symbols. Repetitive reference symbols have sometimes been left out for reasons of clarity.

Figure 1:
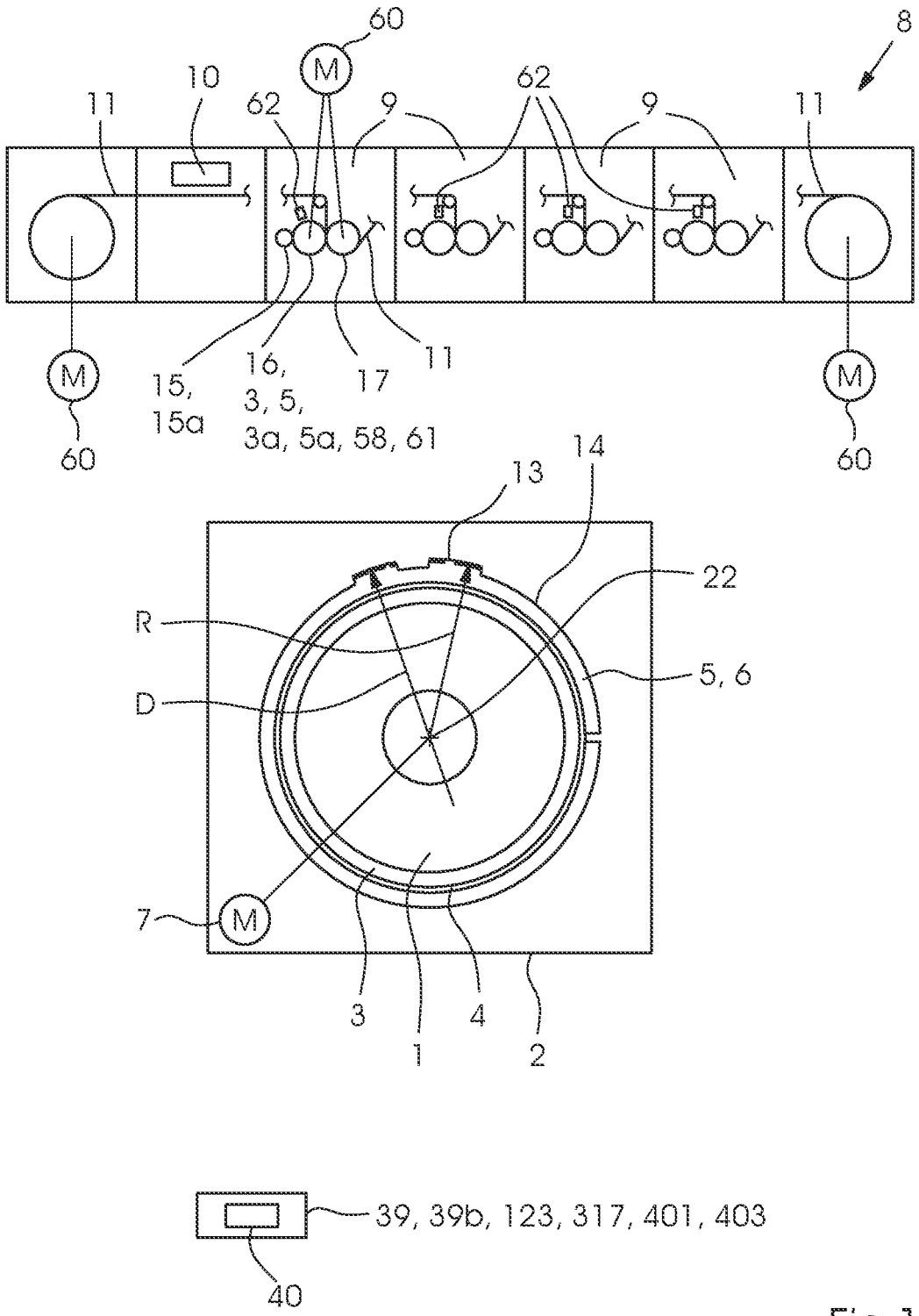
FIGS. 1 to 5 are diagrammatic views illustrating a flexographic printing press, a measuring station including a measuring device (in different embodiments) and a measuring process.

Referring now to the figures of the drawings in detail and first, particularly, to FIG. 1 thereof, there is seen a cross section of a rotatable carrier cylinder 1 of a measuring station 2, a sleeve 3 received on the carrier cylinder, and a printing plate 5 (flexographic printing forme) as a rotary body 6. The printing plate 5 is received on the sleeve 3, preferably fixed to the sleeve by using an adhesive tape 4 (or, alternatively, by using an adhesive coating on the sleeve), which is a process referred to as "mounting," and its topography is to be measured.

A motor 7 may be provided in the measuring station to rotate the carrier cylinder during the measuring operation. The measuring station may be a part of a so-called "mounter" (in which printing plates are mounted to carrier sleeves) or it may be separate from a "mounter." The measuring station may be separate from a printing press 8 (flexographic printing press) which includes at least one printing unit 9 (flexographic printing unit) for the printing plate 5 and at least one dryer 10 for printing on and drying a printing substrate 11, preferably a web-shaped printing substrate. The printing plate is preferably a flexographic printing forme with a diameter of between 106 mm and 340 mm. The dryer is preferably a hot-air dryer and/or a UV dryer and/or an electron beam dryer and/or an IR dryer. The sleeve may be pushed onto the carrier cylinder from the side. Openings for emitting compressed air to widen the sleeve and to create an air cushion when the sleeve is slid on may be provided in the circumferential surface of the carrier cylinder. The sleeve with the printing plate may be removed from the measuring device after the measuring operation to be slid onto a printing cylinder of the printing unit in the printing press. A hydraulic mounting system may be used as an alternative to the pneumatic mounting system.

In addition, FIG. 1 illustrates a digital computer and/or a digital memory 39, 39*b*, 123, 317, 401 and/or 403. The measuring device may produce data and transmit it to the computer/memory. The data may be measured values obtained by measuring the sleeve 3 and/or the flexographic printing forme(s) 5 or data derived therefrom. The computer/memory may be a part of the measuring device 2 or a part of the flexographic printing press 8; it may also be separate, for instance a central computer/memory (for instance in a print shop) or a cloud-based computer/memory. The computer/memory may transmit data to the flexographic printing press, for instance the measured values or the data derived therefrom or data further derived therefrom. The data further derived therefrom may be data created by a computer-implemented algorithm and/or by AI (Artificial Intelligence; a software and/or hardware-based self-learning and machine-learning system). The computer/memory may receive data from multiple measuring stations and transmit data to multiple flexographic printing presses. The system formed of flexographic printing press(es), measuring station(s), and computer/memory provides a high degree of automation in the printing process even as far as autonomous printing; error-prone inputs and/or modifications of data made by an operator may advantageously be avoided.

The measuring station 2 may be calibrated with the aid of measuring rings 12 provided on the carrier cylinder 1. Alternatively, a measuring sleeve or the carrier cylinder itself may be used for calibration purposes.

Figure 2A:
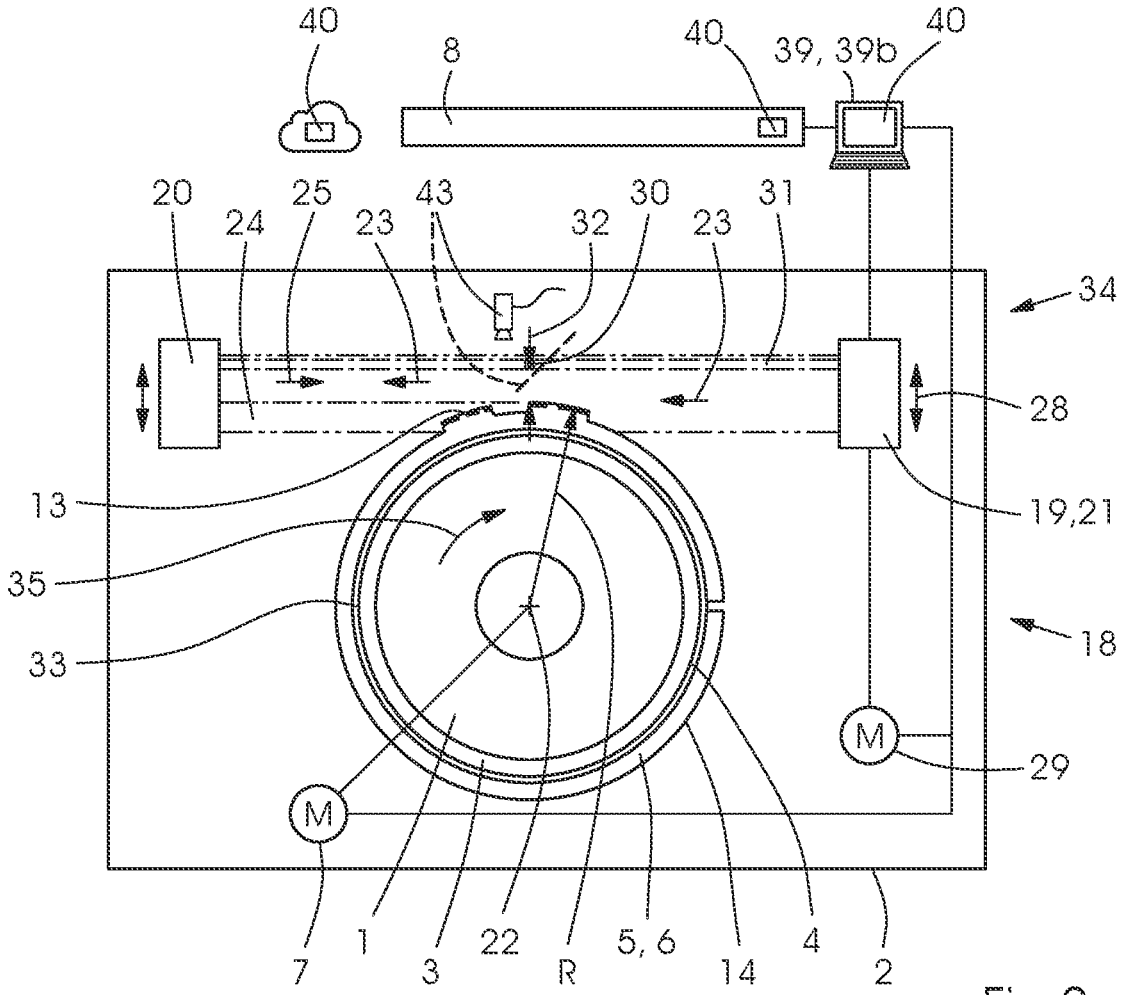
Figure 2C:
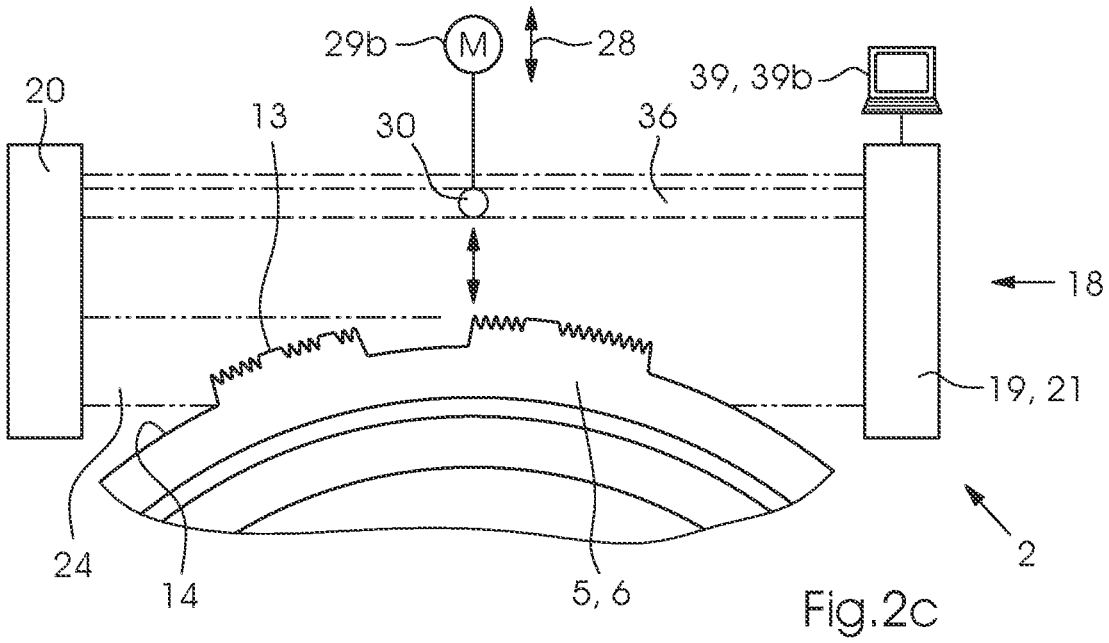

The following figures illustrate preferred embodiments of devices for taking contact-free measurements of elevations 13 on the surface 14 of a rotary body 6 embodied as a flexographic printing forme of the printing press (cf. FIG. 2C). The elevations may be flexographic printing dots (in the halftone) or flexographic printing surfaces (in a solid area) of a flexographic printing plate. The following exemplary embodiments describe the process of taking measurements on a printing plate 5. Taking measurements on the printing plate allows an automated presetting of the respective optimum operating pressure between the cylinders involved in the printing operation, e.g. the anilox cylinder 15, the printing cylinder 16 with the printing plate 5, and the impression cylinder 17.

Figure 2B:
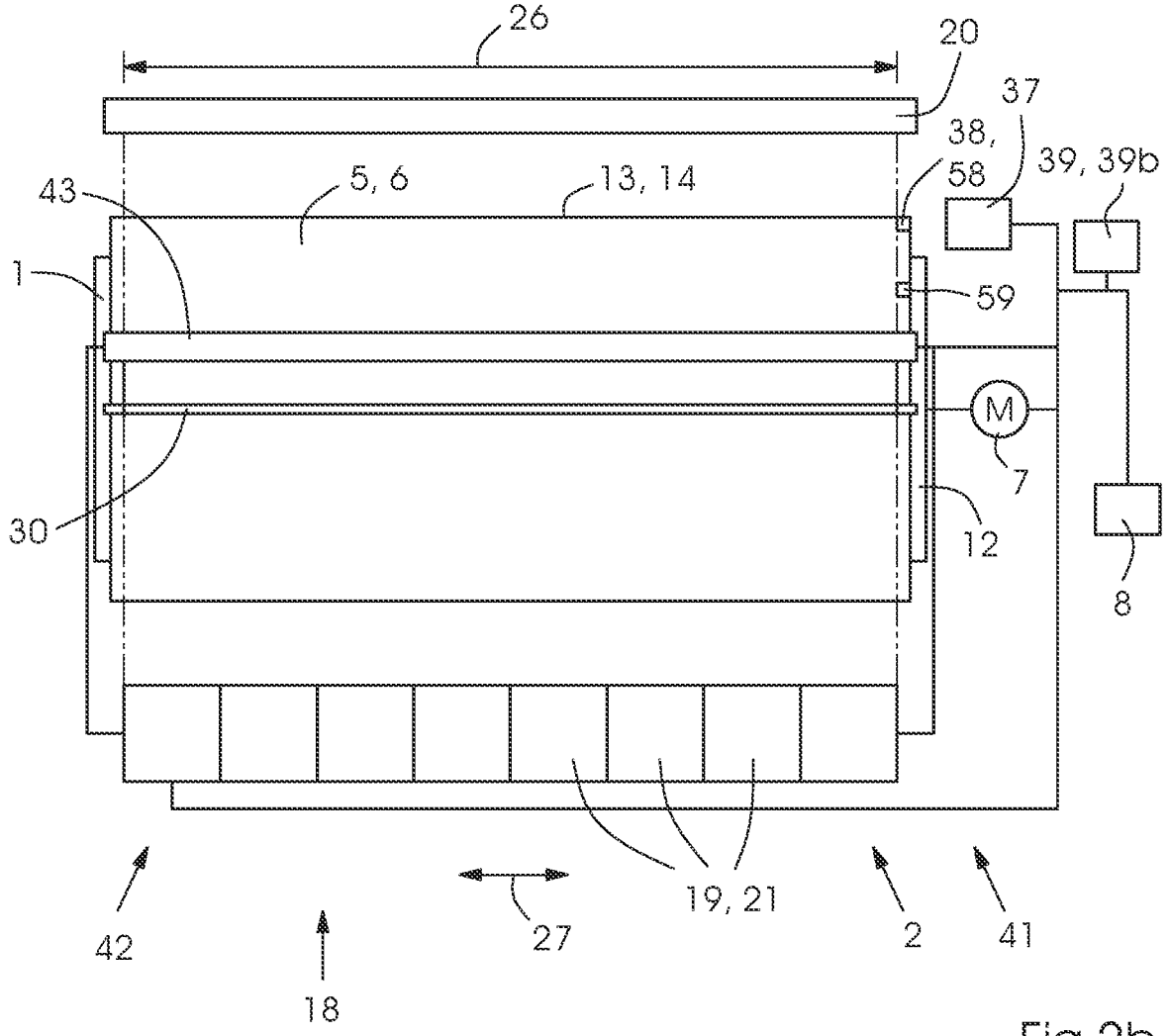

FIGS. 2A to 2C illustrate a preferred embodiment of the device for measuring the topography of a printing plate 5; FIG. 2A is a cross-sectional view, FIG. 2B is a top view, and FIG. 2C is an enlarged section of FIG. 2A. In accordance with this embodiment, the topography is preferably measured by multiple devices 18 in the course of a 3D radius detection with an optional reference line.

In this and the following embodiments, 2D is understood to indicate that a section of the printing plate 5 (for instance an annular height profile) is scanned and 3D is understood to indicate that the entire printing plate 5 (for instance a cylindrical height profile composed of annular height profiles) is scanned.

The device 18 includes multiple radiation sources 19, in particular light sources 19, preferably LED light sources, at least one reflector 20 such as a mirror, and at least one optical receiver 21, preferably an area scan camera and in particular a high-speed camera. The following paragraphs assume that the radiation sources are light sources, i.e. visible light is emitted. Alternatively, the radiation source may emit different electromagnetic radiation such as infrared radiation. The light sources are preferably disposed in a row perpendicular to the axis of rotation 22 of the carrier cylinder 1 and generate a light curtain 23 while the carrier cylinder 1 with the sleeve 3 and the printing plate 5, i.e. the contour, generate a shading 24. The reflected and subsequently received light 25, i.e. substantially the emitted light 23 without the light 24 shaded off by the topography 13, carries information on the topography 13 to be measured. The reflector 20 may be a reflecting foil. The information may be information on printing and non-printing areas and the height thereof on the flexographic printing forme and/or information on the local dot density of the flexographic printing forme.

The light source 19 is two-dimensional. The light source preferably emits visible light. The light sources 19 and the optical receivers 21 preferably cover the working width 26, i.e. the extension of the printing plate 5 in the direction of its axis 22 (for instance 1650 mm). Preferably, n light sources 19 and receivers 21 may be provided, with $2>n>69$, for example. When smaller cameras are used, an upper limit greater than 69 may be necessary. If the entire working width 26 is covered, the printing plate 5 may be measured during one revolution of the carrier cylinder 1. Otherwise the light sources and optical receivers would have to be moved, for instance in a clocked way, in an axial direction 27 along the printing plate.

The preferred cameras for use in the process are inexpensive but fast cameras 21 such as black-and-white cameras. The cameras may record individual images or a film during the rotation of the printing plate 5.

The device made up of the light sources 19, reflector 20, and optical receiver 21 may preferably only be moved in a direction 28 perpendicular to the axis 22 of the carrier cylinder 1 to direct the generated strip of light 23 to the topography 13 to be measured. For this purpose, a motor 29 may be provided. Alternatively, the reflector may be stationary and only the light source and/or the optical receiver may be moved, for example by using a motor.

In contrast to the representation, the measuring operation of the topography 13 is preferably occurs in a perpendicular direction (e.g. camera at the bottom and reflector at the top) and not in a horizontal direction because in this case, any potential bending of the carrier cylinder 1 and reference object 30 may be ignored. For this preferred solution, one needs to imagine FIG. 2A rotated through a 90° angle in a clockwise direction.

A line-shaped object 30, preferably a tautened thread 30 or a tautened piece of string 30 such as a metal wire or a carbon fiber or a blade (or a blade-shaped object or an object with a cutting edge) or a bar, which creates a line 31 of reference for the plurality of optical receivers 21 is provided as an optional reference object 31. The line-shaped object preferably extends in a direction parallel to the axis of the carrier cylinder 1 and is preferably disposed a short distance 32, for instance 2 mm to 10 mm (20 mm at the maximum) away from the circumferential surface 33/the printing plate 5 disposed thereon. The received light 25 further includes information that may be analyzed on the reference object 30 such as its location and/or distance from the surface 14 of the printing plate 5 (the surface being preferably etched and therefore on a lower level than the elevations 13). The reference line may be used to determine the radial distance R of the topography 13/contour or the contour's elevations from the reference object 30, preferably by using digital image processing. The distance between the reference object 30 and the axis 22 of the carrier cylinder 1 is known due to the configuration and/or a motorized adjustment of the reference object 30 (optionally together with the light source 19 and the optical receiver 21 and the reflector 20 if provided). Thus, the radial distance of the contour elevations, i.e. the radius R of the print dots, may be determined by computation. Due to the use of the reference object 30 and the presence of shades created by it/of a reference line 31 corresponding to the shade (in the recorded image/from the received light) of every camera 21 a precise alignment of the cameras relative to one another is not strictly necessary. Moreover, the reference object 30 may be used to calibrate the measuring system.

For the purpose of movement/adjustment in a direction 28, the reference object 30 may be coupled to the light source 19 and/or to the motor 29. Alternatively, the reference object may have its own motor 29*b* for movement/adjustment purposes.

For an initial referencing of the device, a measurement preferably is taken on an ("empty") carrier cylinder or on a measuring sleeve disposed thereon (measuring the distance between the reference object and the surface from DS to OS).

For a further initialization of the device before the measuring operation, a first step preferably is to move the area scan camera 21 towards the carrier cylinder 1. The movement is preferably stopped as soon as the camera detects preferably the first elevation. Then the reference object 30 is preferably likewise moved in direction 28 until a predefined distance, e.g. 2 mm from the carrier cylinder 1 is reached.

Light source 19 and optical receiver 21 may alternatively be disposed on opposite sides of the carrier cylinder 1; in such a case no reflector 20 is required.

The light source 19, the reflector 20 (if it is present in the embodiment), the optical receiver 21 and the optional reference object 30 form a unit 34, which is movable (in a direction perpendicular to the axis 22 of the carrier cylinder), in particular adjustable or slidable by a motor.

During the measuring operation, the carrier cylinder 1 and the printing plate 5 located thereon rotate to ensure that preferably all elevations 13 may be scanned in the circumferential direction 35. Based thereon, a topographic image and the radius R of individual elevations 13, e.g. flexographic printing dots, from the axis 22 or the diameter D (measured between opposite elevations) may be determined as a function of the angular position of the carrier cylinder 1.

In the enlarged view of FIG. 2C, a section of the topography 13 of the printing plate 5 as well as the shading 24 of the topography and the shading 36 of the reference object 30 are visible. The topographic elevations 13 may be in a range between 2 μm and 20 mm.

In addition, a sensor 37 may be provided to scan the sleeve 3 and/or the printing plate 5 for an identification feature 38 (cf. FIG. 2B). This feature may, for instance, be a bar code, a 2D code such as a QR code or a data matrix code, a RFID tag, or a NFC tag.

The signals and/or data generated by the light receivers 21 and including information on the topography 13 of the measured surface 14 and on the reference object 30 are transmitted to a computer 39 to be processed, preferably through a wire or a wireless connection. The computer is connected to the printing press 8. The computer 39 analyzes the information.

Before the measurement, the reference object 30 may be moved into the reception range of the optical receiver 21 to calibrate the optical receiver. The optical receiver 21 detects the reference object and transmits the signals generated in the calibration to the computer 39. The calibration data are saved in the digital memory 40 of the computer 39.

This provides a way of saving a virtual reference object on the computer 39.

Subsequently, the reference object 30 is removed from the range of the optical receiver 21 and the topography 13 of the surface 14 to be measured is processed together with the virtual reference object.

The result of the analysis is saved in a digital memory 40 of the computer, in a digital memory 40 of the printing press, or in a cloud-based memory. The saved results are preferably saved in association with the respective identification mark 38. When the sleeve-mounted printing plate 5 (or sleeve/flexographic printing forme) is used in the printing press 8 at a later point, the identification feature 38 of the printing plate 5/flexographic printing forme (or sleeve) may be scanned again to access the values associated with the identification mark 38, for instance for presetting purposes. For instance, the printing press may receive the data required for a print job from the cloud-based memory.

The result of the analysis may preferably include up to four values: The printing pressure adjustments on the two sides 41/DS (drive side) and 42/OS (operator side) between the printing cylinder 16, i.e. the cylinder carrying the measured printing plate 5, and the impression cylinder 17 or printing substrate transport cylinder 17, and the printing pressure adjustments between an anilox roller 15 for inking the measured printing plate 5 and the printing cylinder 16 as they are required during operation.

In addition, a device 43 for determining dot density, for instance by optical scanning, may be provided, preferably a CIS (contact image sensor) scan bar, a line scan camera, or a laser triangulation device. Alternatively, the device 43 may be a mirror which may pivot or be movable in a way for it to be usable together with the light sources 19, 21 to measure dot density. The device is preferably connected to a device for image processing and/or image analysis, which is preferably identical with the computer 39—i.e. the computer 39 programmed in a corresponding way—or which may be a further computer 39*b*.

A CIS scan bar may be disposed to be axially parallel with the cylinder. It preferably includes LED for illumination and sensors for recording images (similar to a scan bar in a commercial copying machine). The bar is preferably disposed at a distance of 1 to 2 cm from the surface or is positioned at this distance. The cylinder with the surface to be measured, e.g. the printing plate, rotates underneath the bar, which generates an image of the surface in the process to make it available for image analysis to determine dot density. The data obtained from the dot density determination process may additionally be used, for instance, computationally to select or recommend the best anilox roller from among a plurality of available anilox rollers for the printing operation with the recorded printing forme.

Figure 3A:
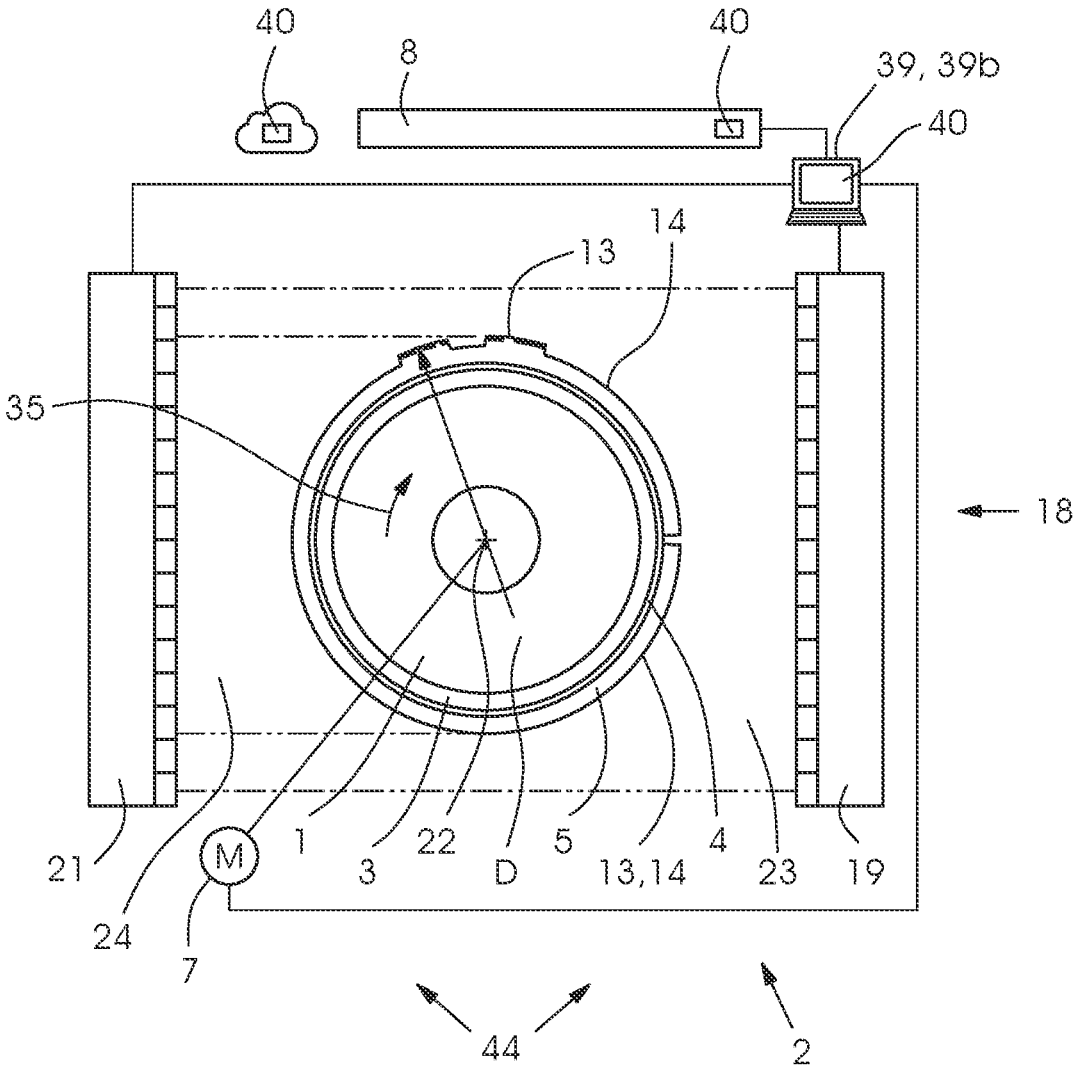
Figure 3B:
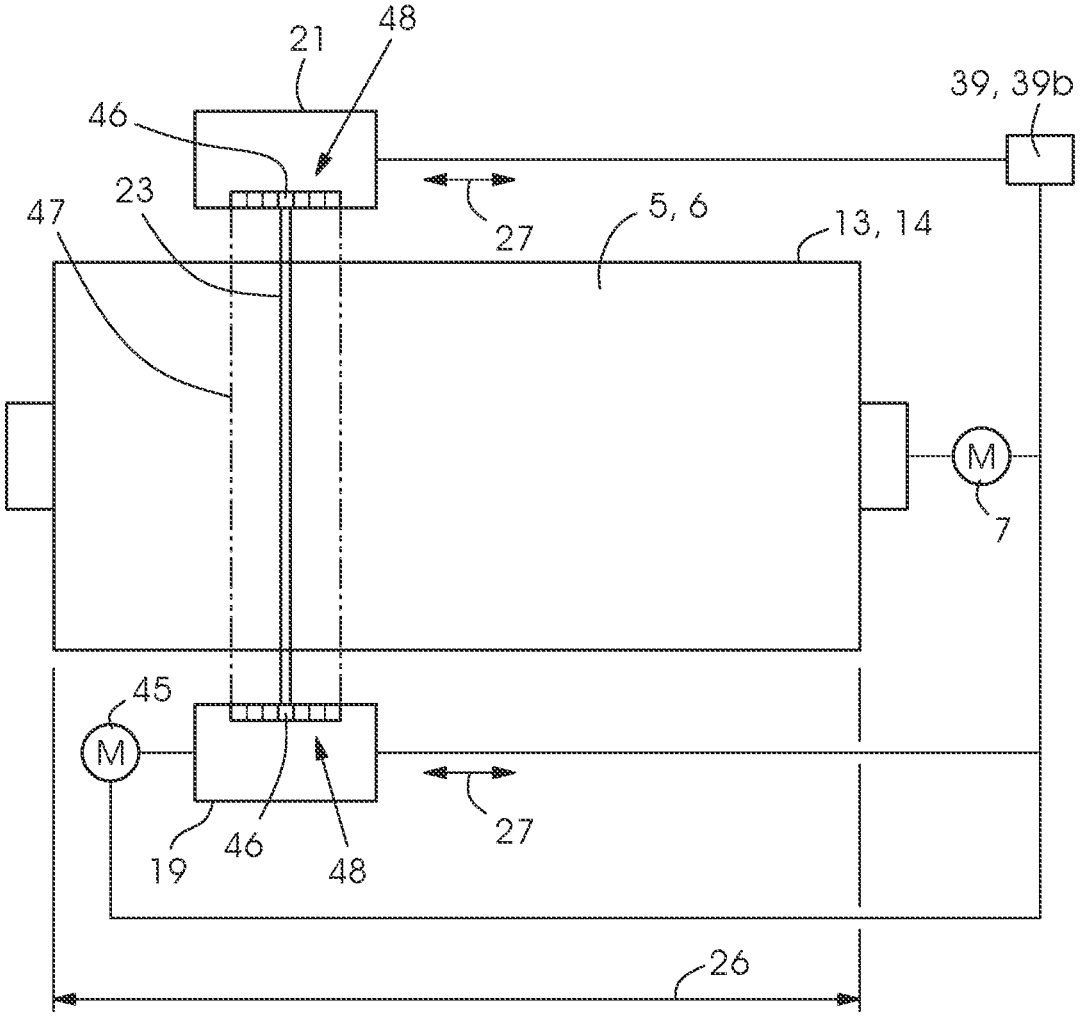

FIGS. 3A and 3B illustrate preferred embodiments of the device for measuring the topography of a printing plate 5; FIG. 3A is a cross-sectional view and FIG. 3B is a top view. In accordance with this embodiment, the topography is preferably scanned by a laser micrometer 44 in the course of a 2D diameter determination process.

The device includes a light source 19, preferably a line-shaped LED light source 19 or a line-shaped laser 19, and an optical receiver 21, preferably a line scan camera 21. Together, the laser and optical receiver form a laser micrometer 44. The light source 19 generates a light curtain 23 and the carrier cylinder 1 with the sleeve 3 and the printing plate 5 creates a shading 24. The line lengths of the light source 19 and the optical receiver 21 are preferably greater than the diameter D of the carrier cylinder including the sleeve and printing plate to allow the topography to be measured without any movement of the device 44 perpendicular to the axis 22 of the carrier cylinder. In other words, the cross section of the carrier cylinder is completely within the light curtain.

The device 44 including the light source 19 and the optical receiver 21 may be moved in a direction parallel to the axis 22 of the carrier cylinder (in direction 27) to record the entire working width 26. For this purpose, a motor 45 may be provided.

A sensor 37 for identifying the sleeve 3 and/or the printing plate 5 based on an identification feature 38 may be provided (cf. FIG. 2B).

The signals and/or data generated by the optical receivers 21 are transmitted for further processing, preferably by wire or wireless connection, to a computer 39. The computer is connected to the printing press 8.

Light source 19 and optical receiver 21 may alternatively be disposed on the same side of the carrier cylinder 1; if this is the case, a reflector 20 is disposed on the opposite side in a way similar to the one shown FIGS. 2A and 2C.

In accordance with an alternative embodiment, the topography is preferably recorded using a laser micrometer 44 in the course of a 2D diameter determination process, which does not only record an individual measuring row 46, but a wider measuring strip 47 (illustrated in dashed lines) formed of multiple measuring rows 48 (illustrated in dashed lines). In this exemplary embodiment, the light source 19 and the optical receiver 21 are preferably two-dimensional and not just line-shaped. The light source 19 may include multiple light rows 48 of a width of approximately 0.1 mm and at a distance of approximately 5 mm from one another. In this example, the camera is preferably an area scan camera.

Figure 4A:
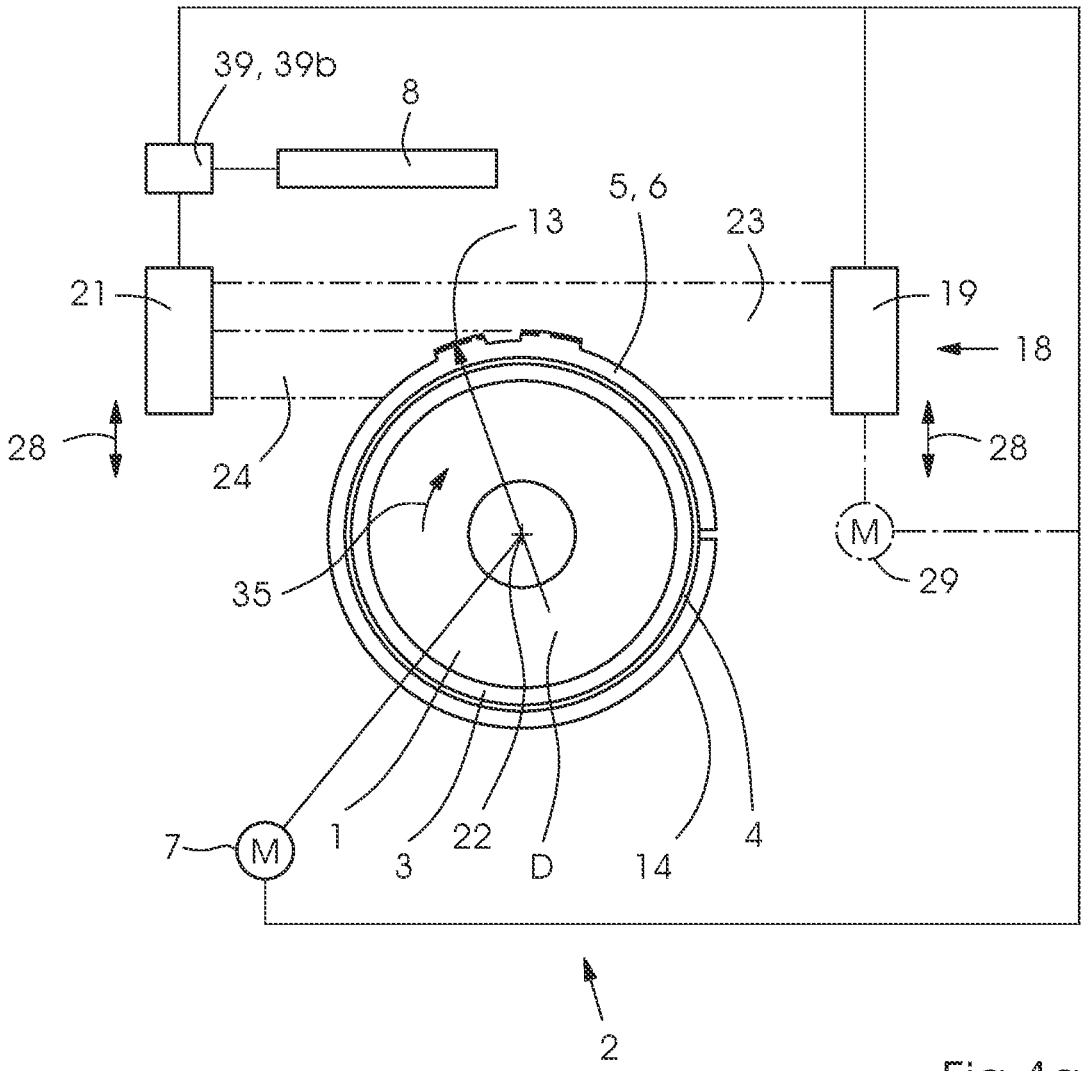
Figure 4B:
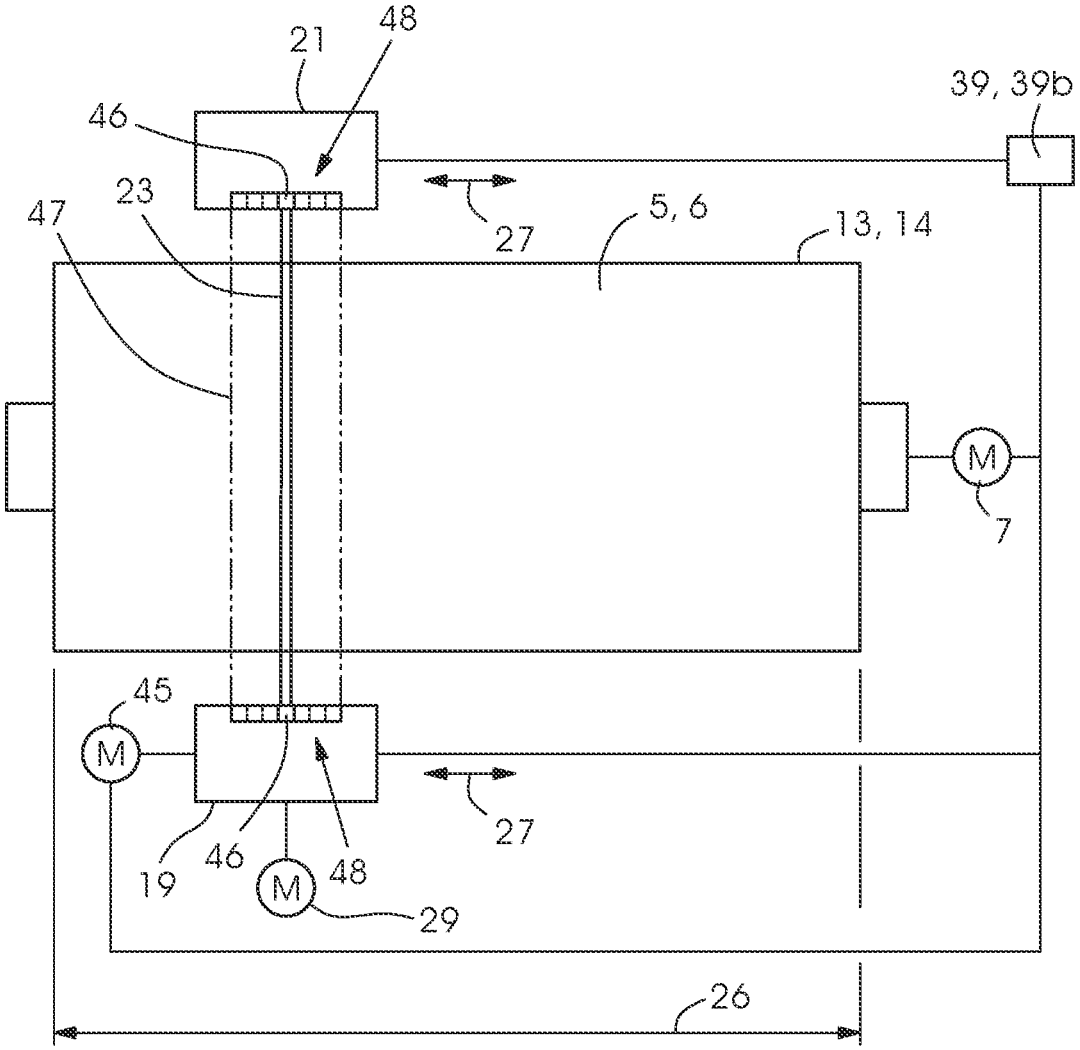

FIGS. 4A and 4B illustrate a preferred embodiment of the device for measuring the topography of a printing plate 5; FIG. 4 is a cross-sectional view and FIG. 4 is a top view. In accordance with this embodiment, the topography is preferably scanned by a laser micrometer in the course of a 2D diameter determination process.

The device includes a light source 19, preferably an LED light source 19, and a light receiver 21, preferably a line-shaped LED light source 21 or a line-shaped laser 21. The light source 19 generates a light curtain 23 and the carrier cylinder 1 with the sleeve 3 and the printing plate 5 creates a shading 24.

The device made up of the light source 19 and optical receiver 21 may preferably be moved in a direction 28 perpendicular to the axis 22 of the carrier cylinder 1 to direct the light curtain 23 to the topography 13 to be measured. For this purpose, a motor 29 may be provided. In a case in which the light curtain 23 is wide enough to cover the entire measuring area, the motor 29 is not necessary.

The signals and/or data generated by the optical receivers 21 are transmitted for further processing, preferably by wire or wireless connection, to a computer 39. The computer is connected to the printing press 8.

The light source 19 and the optical receiver 21 may alternatively be disposed on the same side of the carrier cylinder; if this is the case, a reflector 20 is disposed on the opposite side in a way similar to the one shown FIGS. 2A and 2C.

In accordance with an alternative embodiment, the topography 13 is preferably scanned using a laser micrometer 44 in the course of a 3D diameter determination process, which does not only record one measuring row 46, but a wider measuring strip 47 (illustrated in dashed lines), i.e. multiple measuring rows 48 at the same time. In this embodiment, the light source 19 and the optical receiver 21 are two-dimensional and not just line-shaped.

In accordance with a further alternative embodiment, the topography 13 is preferably scanned using a laser micrometer 44 in the course of a 3D diameter determination process, in which the device including the light source 19 and the optical receiver 21 may preferably be moved in a direction 28 perpendicular to the axis of the carrier cylinder 1 to direct the light curtain 23 to the topography 13 to be measured. For this purpose, a motor 29 (illustrated in dashed lines) may be provided.

In accordance with an alternative embodiment, the topography 13 is preferably scanned using a laser micrometer 44 in the course of a 3D radius determination process, in which the two latter alternative embodiments are combined.

Figure 5:
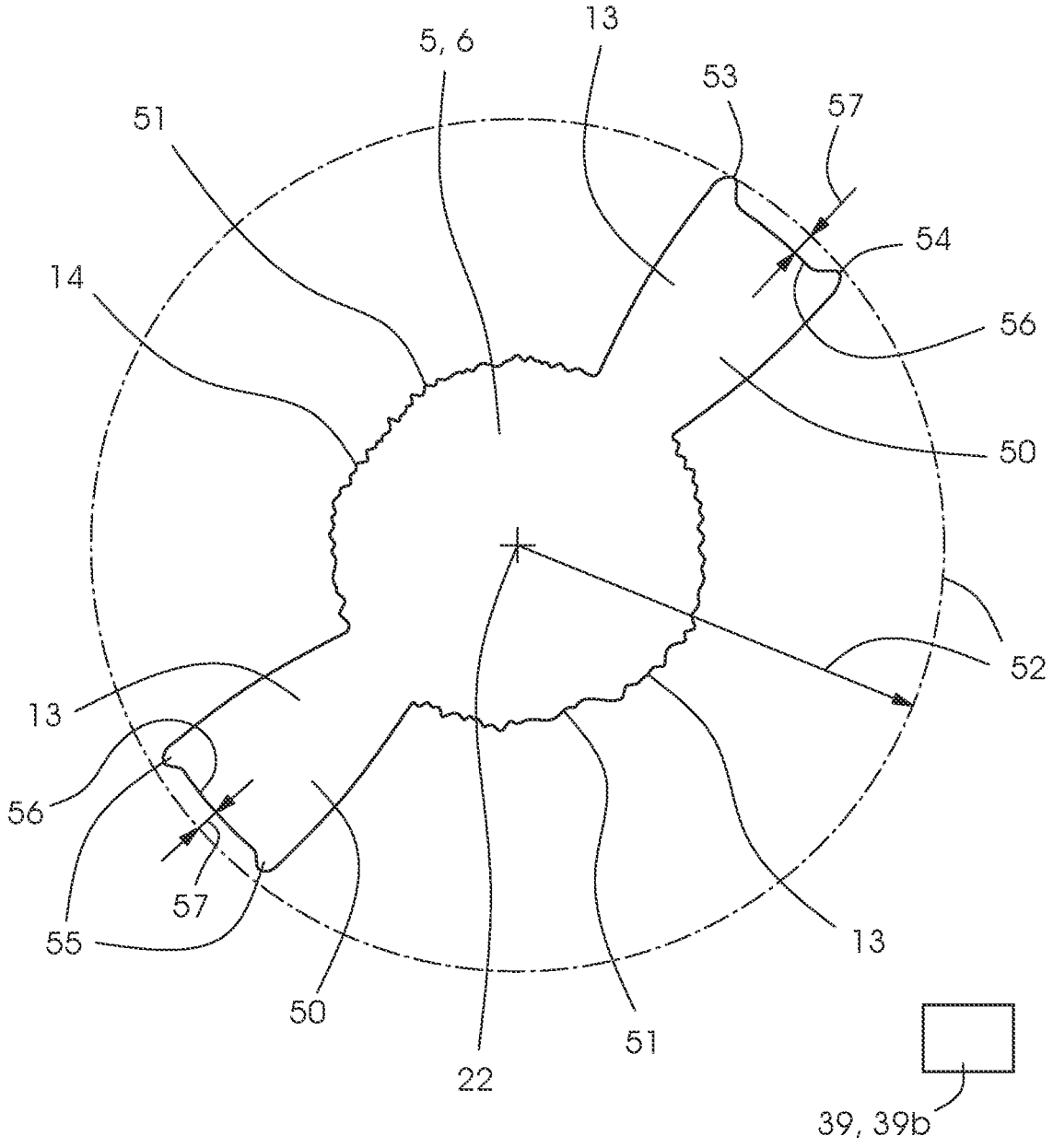

FIG. 5 is a much enlarged representation of an example of a topography measurement result of a printing plate 5 (flexographic printing forme) with two printing areas 50 and two non-printing areas 51. The radial measurement results for 360° at an axial location (relative to the axis of the carrier cylinder) are shown. The non-printing areas may for instance have been created by etching and thus have a smaller radius than the printing areas.

In the drawing, an enveloping radius 52/an envelope 52 of the dots with the greatest radius on the printing plate 5, i.e. of the highest elevations of the topography 13 at the axial location is shown.

A dot 53 on the printing plate 5 is a printing dot because during a printing operation at a normal pressure/printing pressure between the printing plate 5 and the printing substrate 11/transport cylinder 17 this dot would have sufficient contact with the printing substrate and the ink-transferring anilox roller. A normal pressure setting creates a so-called kissprint, which means that the printing plate just barely touches the printing substrate and that the flexographic printing dots are not compressed to any greater extent.

A dot 54 is a dot which would only just print at a regular printing pressure setting during a printing operation because it would only just be in contact with the printing substrate.

Two dots 55 are dots which would not print because at regular pressure during a printing operation they would not be in contact with the printing substrate nor with the anilox roller.

A computer program which computationally identifies the radially lowest point 56 in the printing area 50 and its radial distance 57 to the envelope 52, for instance by using digital image processing, runs on the computer 39. This computation is made at regular intervals along the axial direction, for instance from DS to OS at all measuring points to find the respective maximum of the lowest points (i.e. the absolutely lowest value) from the DS to the center and from the center to the OS. The two maximums or the adjustment values computationally obtained therefrom may for instance be selected as the respective printing pressure/setting for DS and OS during the printing operation, i.e. the cylinder distance between the cylinders involved in the printing operation is reduced by the setting on DS and OS. A motor-driven threaded spindle may be used on DS and OS for this purpose.

The following is a tangible numerical example:

On one side, the resultant distance is deltaR=65 μm and on the other side the resultant distance is deltaR=55 μm. For all dots 53 to 55 on the printing plate to print, 65 μm need to be set.

In all of the illustrated embodiments and the alternatives that have been given, the runout resulting from the manufacturing process and/or from the use of the sleeve 3 (due to wear) may be measured and may be factored in during the printing operation on the basis of the measurement and analysis results to improve the quality of the printed products. When a predefined runout tolerance is exceeded, an alarm may be output. The measurement may be taken on smooth and porous sleeves.

In accordance with the invention, radar emitters 19 (in combination with suitably adapted receivers) may be used instead of the light sources 19 or light emitters 19 (which emit visible light).

In all of the illustrated embodiments and the alternatives that have been given, parameters for a dynamic pressure adjustment may be determined and passed on to the printing press. In this process, a delayed expansion of the deformable and/or compressible print dots 53 to 55 made of a polymeric material may be known (for instance pre-measured) and made available to the computer 39 to be factored in. Or a hardness of the printing plate which has been pre-measured using a durometer may be used. The expansion may in particular be a function of the printing speed during operation, i.e. this dependency on the printing speed may be factored in. For instance at higher printing speeds, a higher printing pressure setting may be chosen.

What may likewise be factored in (as an alternative or in addition to the printing speed) is the printing surface of the printing plate 5 or the dot density, i.e. the density of the printing dots on the printing plate 5, which may vary from location to location. For instance, at higher dot densities, a higher printing pressure setting may be chosen and/or the dot density may be used to set up dynamic printing pressure adjustment.

The received light 25, i.e. substantially the emitted light 23 minus the light 24 shaded off by the topography, may be used to determine the local dot density. It carries information on the topography 13 to be measured and/or on the surfaces thereof and/or on the elevations thereof.

A device 43 for determining/measuring dot density, i.e. the local values thereof, on the printing forme, for instance a flexographic printing forme, may be provided, preferably in the form of a CIS scan bar or a line scan camera. For instance, on the basis of the data that has been obtained/calculated in the dot density determination process, specification values for different printing pressure settings on DS (drive side of the printing press) and OS (operator side of the printing press) may be provided.

If the dot density of the printing plate 5 and/or of an anilox roller 15 for ink application and/or of an anilox sleeve 15 is known, the expected ink consumption of the printing operation using the printing plate on a given printing substrate 11 may be determined by computation. The ink consumption may then be used to compute the required drying power of the dryers 10 to dry the ink on the printing substrate. The expected ink consumption that has been calculated may also be used to calculate the amount of ink that needs to be provided.

In all of the illustrated embodiments and the alternatives that have been given, a so-called cylinder bounce pattern may also be factored in. A cylinder bounce pattern is a disturbance that periodically occurs as the printing plate 5 rotates. It is caused by a page-wide or at least detrimentally wide gap or channel usually extending in an axial direction in the printed image, i.e. a detrimentally large area without printing dots, or any other type of axial gap. Such gaps or the cylinder bounce pattern they cause may affect the quality of the prints because due to the printing pressure, the cylinders involved in the printing operation rhythmically get closer and separate again as the channel region returns during rotation. In an unfavorable case, this may result in undesired density fluctuation or in even print disruptions. An existing cylinder bounce pattern may preferably be detected by using a CIS measuring device 43 (e.g. the aforementioned pivoting or movable mirror together with the area scan cameras) or by using an area scan camera, computationally analyzed, and compensated for in the operationally required pressure setting. On the basis of the detected cylinder bounce pattern, for instance, the speeds or rotary frequencies at which vibration would occur in a printing press may be calculated in advance. These speeds or rotary frequencies will then be avoided during production and passed over in the process of starting up the machine.

Every printing plate 5 may have its own cylinder bounce pattern. Gaps in the printing forme may have a negative influence on the print results or may even cause print disruptions. In order to reduce or even eliminate the bouncing of cylinders, the printing plate is checked for gaps in the roll-off direction. If there are known resonance frequencies of the printing unit 9, production speeds that are particularly unfavorable for a given printing forme may be calculated. These printing speeds need to be avoided as "no go speeds."

In all of the illustrated embodiments and the alternatives that have been given, register marks (or multiple register marks such as wedges, double wedges, dots, or cross hairs) on the printing forme may be detected, for instance by using the camera 21 or 43 and a downstream digital image processor, and their positions may be measured, saved, and made available. Thus register controllers or the register sensors thereof may automatically be adapted to register marks or axial positions. Thus errors which may otherwise be caused by manual adjustments of the sensors may advantageously be avoided. Alternatively, patterns may be detected and used to configure a register controller. It is also possible to automatically position a register sensor which is movable by a motor, in particular in an axial direction. It is also possible to compare a predefined zero point of the angular position of a printing cylinder and/or of a sleeve disposed thereon to an angular value of the actual location of a printed image (which has for example been glued on by hand), in particular in the circumferential direction (i.e. of the cylinder/sleeve). This comparison may be used to obtain an optimum starting value for the angular position of the cylinder/sleeve. In this way, register deviations may be reduced at the start of the production run. The same is true for the lateral direction (of the cylinder/sleeve).

In all of the illustrated embodiments and the alternatives that have been given, the power of the dryer 10 of the printing press 8 may likewise be controlled (potentially in a closed control loop). For instance, LED dryer segments may be switched off in areas in which no printing ink has been applied to the printing substrate, thus advantageously saving energy and prolonging the useful life of the LED.

In accordance with another advantageous feature, the power of the dryer 10 or of individual segments of the dryer may be reduced for areas on the printing plate which have a low dot density. This may save energy and/or prolong the useful life of a dryer or of individual segments. The stopping or reduction may occur in specific areas on the one hand and in a direction parallel to and/or transverse to the axial direction of a printing plate and to the lateral direction of the printing substrate to be processed by it. For instance, segments or modules of a dryer may be switched off in areas which correspond to gaps between printing plates (for instance printing plates which are spaced apart from one another, especially ones that have been glued on by hand).

In all of the illustrated embodiments and the alternatives that have been given, the respective location (on the printing plate 5) of measuring fields for print inspection systems may be detected and made available for further uses such as a location adjustment of the print inspection systems.

An inline color measuring system may be positioned in all of the illustrated embodiments and the alternatives that have been given. In order to determine the location and thus the position of the inline color measurement, an image and/or pattern recognition process is implemented to find the axial position for the measuring system. In order to provide a free space for calibration to the printing substrate, the inline color measurement system may be informed of unprinted areas.

The following section is an example of an entire process which may be carried out by a suitable embodiment of the device.

Measuring Process:

Step 1: Sleeve 3 with or without a printing plate 5 is slid onto the carrier cylinder 1 of the measuring station 2 on the air cushion and is then locked on the carrier cylinder 1.

Step 2: The sleeve is identified by a unique chain of signs 38, which may be a bar code, a 2D code (such as a QR code or a data matrix code), an RFID tag, or an NFC tag.

Step 3: Camera 21 and optionally the reference object 30 are positioned in accordance with the diameter (of the sleeve with or without the printing plate).

Step 4: The topography 13 of the printing plate, i.e. the radii of the elevations/print dots 53 to 55, is determined with the axis 6 or rather the axial center of the carrier cylinder 22 as the point of reference. In this process, the light source 19 and the camera 21 of the measuring device 18 may move in an axial direction and the carrier cylinder rotates (its angular position is known through an encoder).

Step 5: An area scan is made to detect dot densities, non-printing areas, printing areas, register marks, and/or measuring fields for inline color measurements.

Step 6: A topography algorithm running on a computer 39 is applied and the areas are analyzed through the area scan, including the detection of cylinder bounce patterns and the structure of register mark fields/inline color measurements.

Step 7: Optionally, the hardness of the plate is determined (in shore as the unit of measurement).

Step 8: A dust/hair detector is used.

Step 9: The data of the measured results are saved in a digital memory 40.

Step 10: The measured results are displayed, pointing out dust/hairs, air inclusions, and/or indicating thresholds for runout, eccentricity and/or convexity, for instance.

Step 11: The measurement may be retaken or the sleeve is removed to measure another sleeve.

Set-Up Process:

Step 1: Sleeve 3 with printing plate 5 is slid onto the printing cylinder 16 of the printing press 8 on the air cushion that has been created by applying air to the printing cylinder 16 and is then locked thereon.

Step 2: The sleeve and its unique chain of signs 38 is identified by the respecting printing unit 9, i.e. by a sensor provided therein. This may be done by bar code, 2D code (such as a QR code or data matrix), RFID tag, or NFC tag.

Step 3: The printing unit/printing press accesses the saved data associated with the identified sleeve/printing plate.

Adjustment Process:

Step 1: The so-called kissprint setting (adjustment of the printing/operating pressure) is set for the printing cylinder 16 and the screen cylinder 15, for instance based on the topography, runout, and printing substrate data, to achieve the optimum print setting. The diameter/radius are determined. The diameter/radius are known from the measurement.

Step 2: The pre-register is calculated on the basis of the register mark data on the printing plate or of a point of reference on the sleeve.

Step 3: The dynamic printing pressure adjustment is set in accordance with the determined dot density values, the printed area, the printing speed, and optionally of the printing substrate. Optionally, the hardness of the plate is factored in (in Shore as the unit of measurement).

Step 4: The optimum speed for the web of material is set, for instance on the basis of the calculation of the determined resonance frequencies of the printing unit for the printing plate by detecting the cylinder bounce pattern.

Step 5: The optimum drying power (UV or hot air) is set on the basis of the dot density values and the printed area as well as on the basis of anilox cylinder data (such as pick-up volume), and is optionally dynamically adapted to the speed of the web of material.

Step 6: The ink consumption is calculated on the basis of the dot density values and the printed area as well as on the basis of anilox cylinder data (such as pick-up volume).

Step 7: LED-UV dryer sections in places where the plate has a low dot density or where no drying is needed The register controller is set in a fully automated way on the basis of the obtained register mark data, for instance the mark configuration and the automated positioning of the register sensor-.ful life of the LEDs.

Step 8: The register controller is set in a fully automated way on the basis of the obtained register mark data, for instance the mark configuration and the automated positioning of the register sensor.

Step 9: The measuring position for spectral inline measurement and print inspection of the printed inks is set, information on the location/the measuring position is provided.

Figure 6:
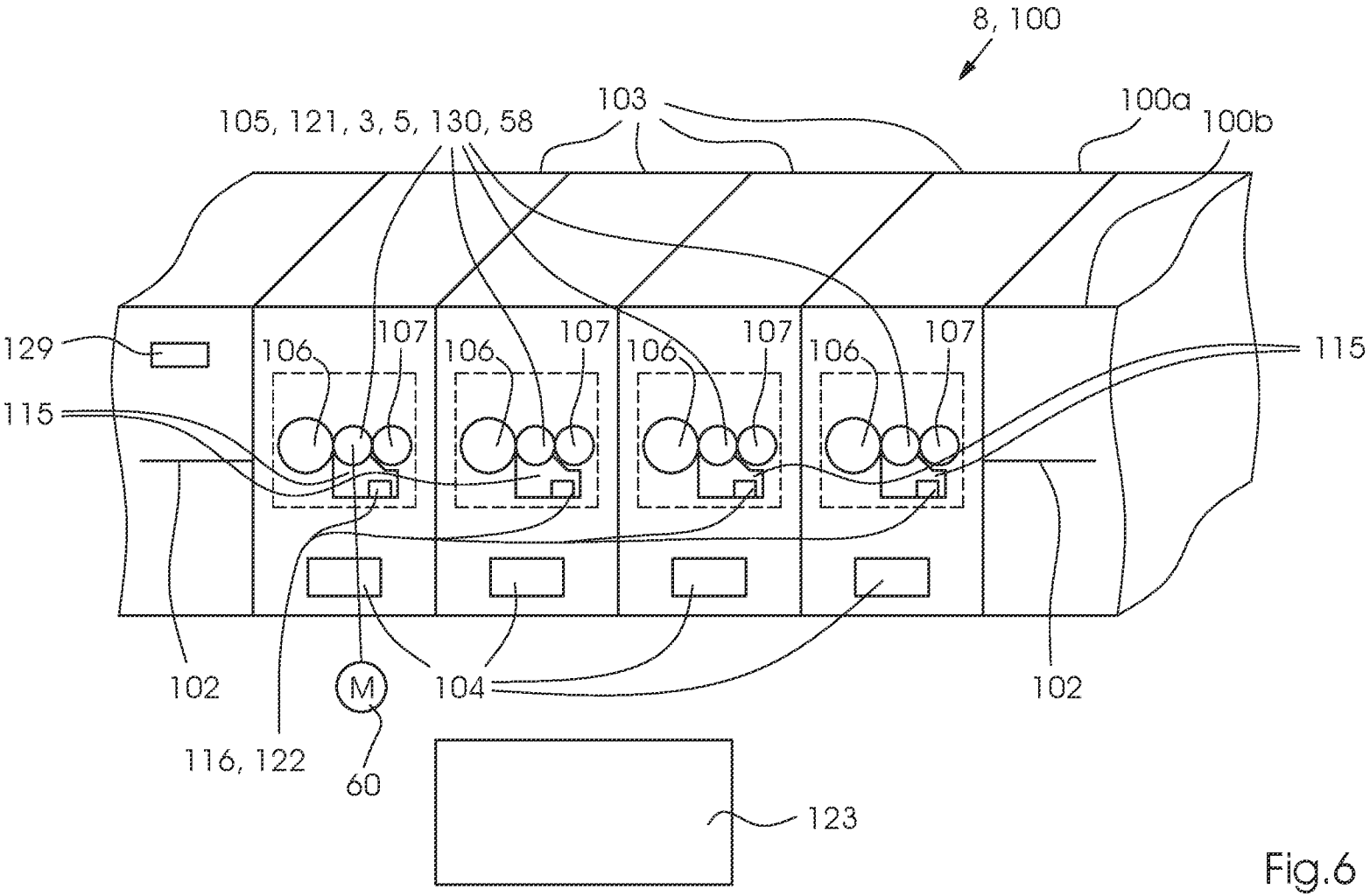
FIGS. 6 and 7 illustrate a flexographic printing press and a device for controlling a contact pressure.

FIG. 6 illustrates an example of a web-fed flexographic printing press 100 implementing a method of the invention.

The machine 100 is of in-line construction and has two longitudinal sides: a drive side 100*a* and an opposite operator side 100*b*. The machine processes or rather prints on a web of printing substrate 102, preferably made of paper, cardboard, paperboard, foil, or a composite material. The web may be provided by using a device for unwinding a web. The machine includes a number of printing units 103 preferably disposed to succeed one another. Every printing unit includes at least one motor 104 for driving the printing unit or at least one cylinder of the printing unit during the printing operation. The web may be further processed, for instance die-cut, after the printing operation.

Figure 7:
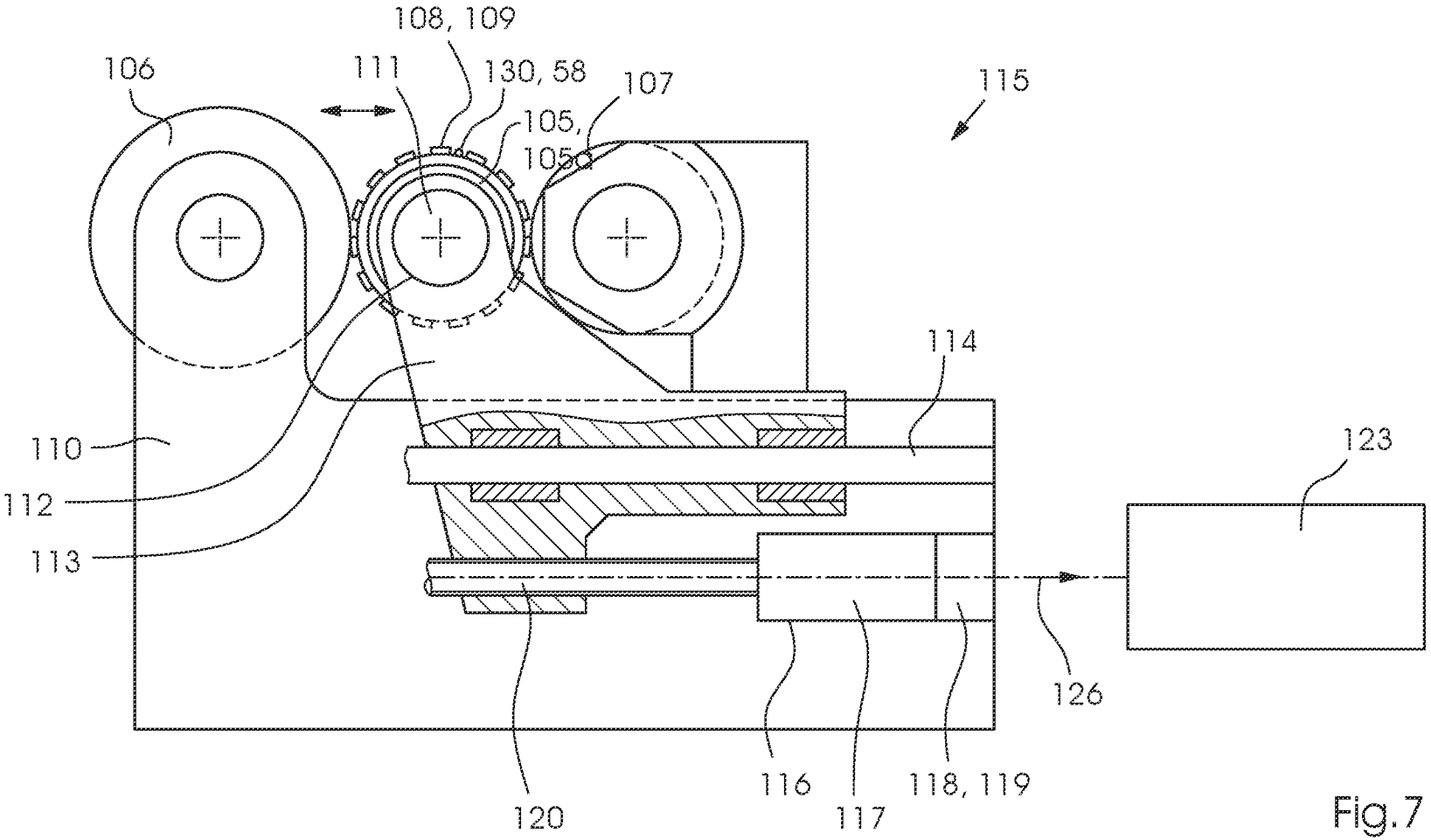

The machine 100 includes multiple printing cylinders 105, 121, in particular flexographic printing cylinders, and associated impression cylinders 106 and anilox rollers 107 (cf. FIG. 7). Every printing cylinder carries a printing forme 108, also known as a stereotype, with a print image 109 made up of printing and non-printing areas, in particular a flexographic printing forme, e.g. a flexographic printing plate, with raised printing portions.

Every printing unit 103, that is at least one or two printing units, preferably includes a control device 115 with a respective actuating drive 116 or 122.

The machine 100 further includes a digital computer 123. Connections for exchanging signals or data with the machine and the components thereof such as the motors 104 or actuating drives 116 are provided even though they are not shown for reasons of clarity.

FIG. 7 illustrates a closed-loop control device 115 as it carries out a method of the invention.

On at least one side (drive side 100*a*/DS or operator side 100*b*/BS), the impression cylinder 106 is received in a frame 110 of the machine 100; a journal 111 of the printing cylinder 105 is received in a bearing 112 of a bearing block 113. The bearing block is movable relative to the frame, preferably in a horizontal direction. A guide 114 is provided for this purpose.

A closed-loop control device 115 is provided on DS and/or OS, preferably for controlling the position of the printing cylinder 5 in a closed control loop and/or preferably for controlling the contact pressure/printing pressure/engagement force between the printing cylinder 105 and the impression cylinder 106 in a closed control loop. The device includes an actuating drive 116, preferably an electric motor 117, especially a servomotor 117, which includes a master 118. The master 118 may be an encoder 119 or include an encoder 119. A spindle 120, preferably a ball screw, is coupled to or disposed on the actuating drive 116. In co-operation with the guide 114, the spindle 120 converts the rotary movement of the actuating drive into a linear movement of the bearing block 113.

The digital computer 123 is connected to the actuating drive 116. The digital computer may control the rotary movements of the actuating drive. Thus the position and/or the contact pressure/printing pressure/engagement force between the printing cylinder 105 and the impression cylinder 106 may be set, in particular controlled, for instance in a closed control loop. The adjustment is made as a function of a dot density of the flexographic printing forme, i.e. of a location-dependent density of printing elevations of the flexographic printing forme or of data computationally derived therefrom. The setting may in particular occur dynamically during the printing operation, i.e. as a function of the rotary speed of the flexographic printing cylinder 105. A further contact pressure, i.e. a contact pressure between the flexographic printing cylinder 105 and the anilox or screen roller 107, may be adjusted by using a motor. For this purpose, the motor 117 or a (non-illustrated) further cylinder may be provided. The adjustment of the further contact pressure during the printing operation may occur dynamically, i.e. as a function of the rotary speed of the printing cylinder and/or as a function of a dot density of the flexographic printing forme, i.e. of a location-dependent density of printing elevations of the flexographic printing forme, or of data derived therefrom.

Figure 8:
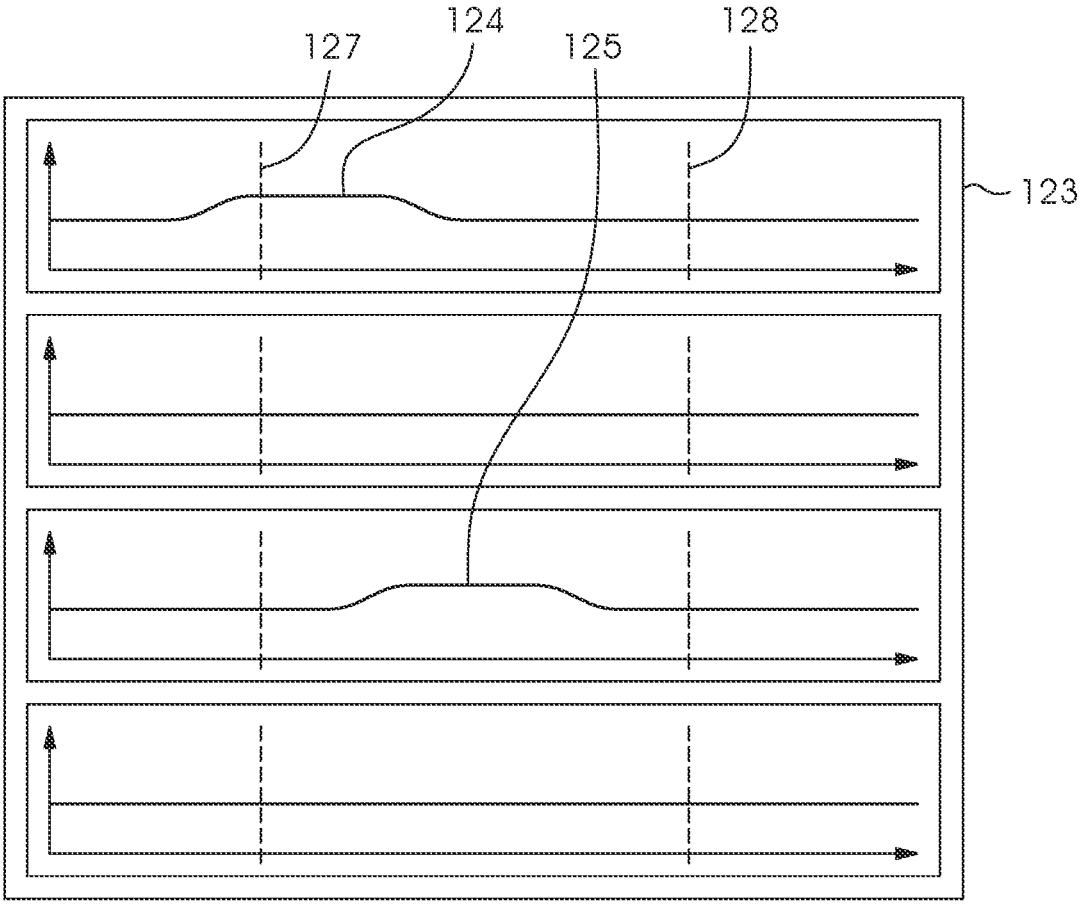
FIG. 8 illustrates a method.

FIG. 8 illustrates selected steps of a preferred embodiment of the method of the invention.

The drawing schematically shows the digital computer 123, which monitors the printing units, of which an exemplary number of four is provided, computationally analyzing the disturbances and compensating for them, reducing them, or preventing them in the process. A diagram is shown for every printing unit (from top to bottom: first to fourth printing unit), plotting the amplitude of a disturbance over the printing speed.

In the illustrated example, a printing speed-dependent disturbance 124 occurs in a first printing unit and a further printing-speed dependent disturbance 125 is caused in a further printing unit, for instance in the third printing unit. The digital computer 123 detects these disturbances at the respective printing speeds. The disturbances may be detected by using a comparison between the amplitude and a predefined threshold. For instance, when a disturbance is detected at a first printing speed 127, the printing speed may be modified until no disturbance occurs at a second speed 128—neither in the first printing unit nor in any other one. Then this second printing speed is the one that is subsequently used to operate the machine 1. In other words, the printing speed is increased (or reduced) until there are no disturbances in any one of the printing units.

Figure 9:
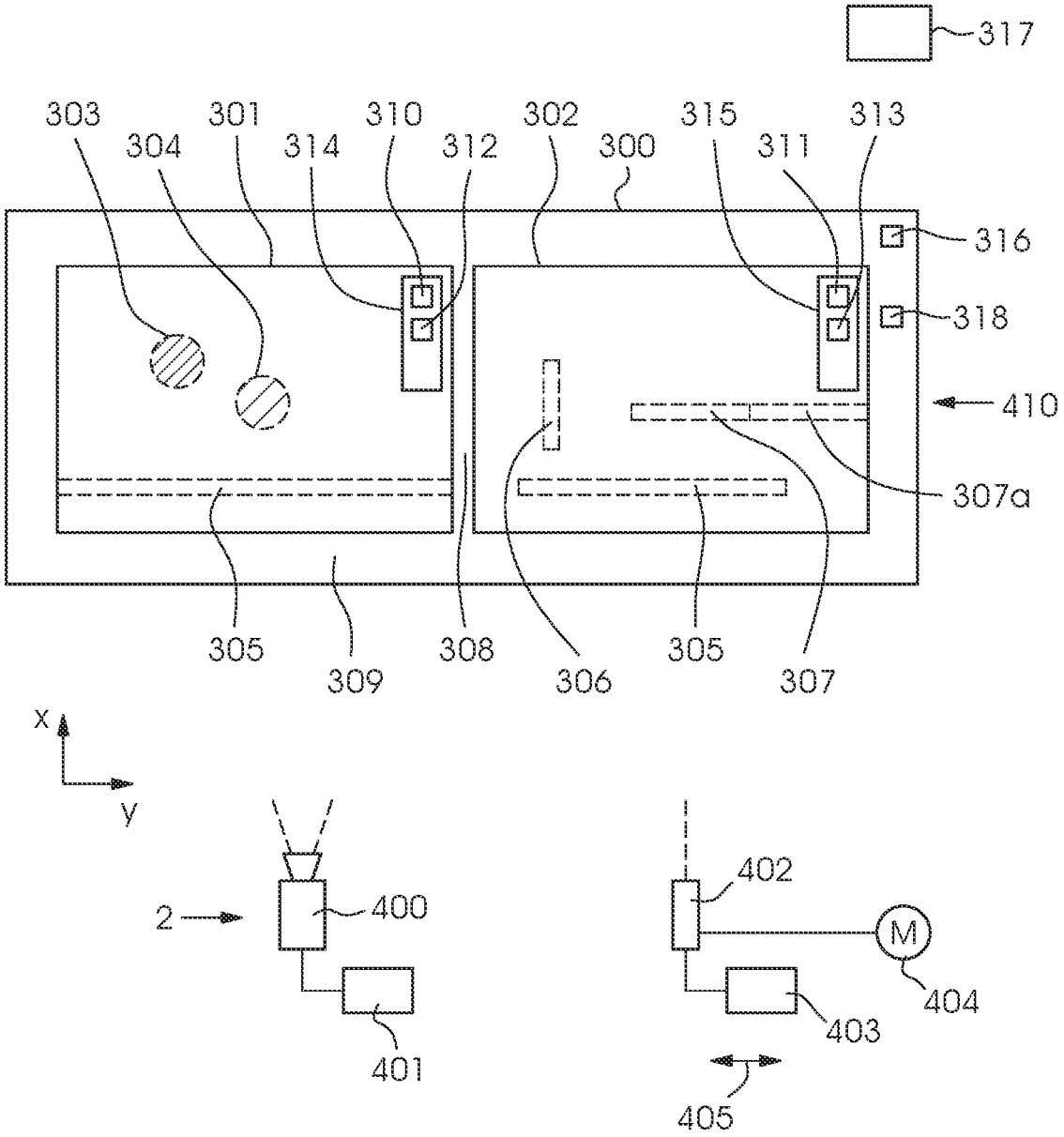
FIG. 9 illustrates a recorded image on a sleeve carrying two flexographic printing formes, by way of example.

FIG. 9 illustrates a recorded image 410 of a sleeve 300 and of two flexographic printing formes 301 and 302 shown as an example. The image has preferably been recorded/generated by a camera 400, in particular in a measuring station 2. The image may be transmitted to a computer 401. This computer may be the computer 39 shown in FIG. 2A. The image may be subjected to computational image processing to obtain information/data. These data may be saved in a digital memory 317 in association with an ID/an identifier 316 on the sleeve and may be made available to the flexographic printing press when the sleeve is used and the ID is called up.

The figure illustrates an example of a recorded area 303 of a high dot density and a recorded area 304 of a low dot density. The areas may be detected and separated by an image processing system and may preferably be color-coded. The knowledge of the local dot densities of the entire flexographic printing forme 301 (and of the further flexographic printing forme 302) may be used to computationally determine a presetting for the so-called printing pressure, i.e. a setting of the contact pressure between the flexographic printing cylinder and the impression cylinder (and/or the anilox roller) when the sleeve is in use.

The figure also shows an example of a detected gap 305. In the region of the gap 305 there are no (or hardly any) printing elevations on the flexographic printing forme 301. The gap 305 primarily extends in an axial y direction and has an axial length in a direction y (and a width in a direction x) that makes it critical in terms of potential cylinder bouncing when the gap passes the printing nip and thus in terms of potentially detrimental vibration. Gaps 306 and 307 are two examples of gaps that are uncritical from this point of view because of their dimensions and because they are adjacent to printing areas 307*a*. The same is true for the gap 308 formed between the two flexographic printing formes 301 and 302 which are mounted at a distance from one another (e.g. glued to the sleeve 300). The gap 309 between the leading and trailing edges of the flexographic printing forme 301 however may be critical. Critical gaps are computationally detected and preferably identified as such.

The figure also shows two examples 310 and 311 of register marks as well as color measurement fields 312 and 313. In the illustrated example the marks and fields are disposed in control strips 314, 315, respectively. The marks and fields are preferably likewise recorded by the camera 400, recognized by an image processing system, and separated. Their positional data (x-y localisation) are saved in association with the ID 316 of the sleeve.

The figure further shows an example of a so-called error mark 318 for detecting a faulty mounting of a flexographic printing forme or of multiple flexographic printing formes on the sleeve or on multiple sleeves. Their positional data are likewise saved in association with the ID 316 of the sleeve.

FIG. 9 further illustrates a sensor 402. The sensor 402 may be a register sensor and/or a spectrometer, which is/are in particular disposed in the flexographic printing unit of the flexographic printing press and directed towards the web of printing substrate 11. The sensor is connected to a computer 403 and may be moved in an axial direction y 405 by using a motor 404 and may thus be positioned in an automated way. Using the data generated from the image 410 and making them available to the printing press when the sleeve 300 is being used, the sensor may be positioned along the printing substrate 11 to the y position of a mark 310, 311 to be printed and recorded and/or the same sensor or a further sensor may be positioned along the printing substrate 11 in field 312, 313 for instance for color inspection by using a spectrometer. The data generated by the sensor are then forwarded to the computer 403, which may be the same as computer 401 and/or as computer 39.

The following is a summary list of reference numerals and the corresponding structure used in the above description of the invention:

1 carrier cylinder
2 measuring station
3 sleeve
3*a* ID of the sleeve
4 adhesive tape
5 printing plate/flexographic printing forme flexographic printing forme
5*a* ID of the printing plate/flexographic printing forme
6 rotary body/flexographic printing forme
7 first motor
8 printing machine/flexographic printing press
9 printing unit/flexographic printing unit
10 dryer
11 printing substrate
12 measuring rings
13 elevations/topography
14 surface
15 anilox roller/anilox cylinder
15*a* ID of the anilox roller/anilox cylinder
16 printing cylinder
17 impression cylinder/printing substrate transport cylinder
18 measuring device
19 radiation sources, in particular light sources
20 reflector/mirror
21 radiation receiver, in particular optical receiver such as cameras
22 axis of rotation
23 light curtain/emitted light
24 shading
25 reflected light
26 operating width
27 axial direction
28 direction of movement
29 second motor
29*b* further second motor
30 reference object/line-like object, in particular thread/string/blade/bar
31 line of reference
32 distance
33 circumferential surface
34 unit
35 circumferential direction
36 shading
37 sensor
38 identification mark/ID
39 digital computer
39*b* further digital computer
40 digital memory
41 drive side (DS)
42 operator side (OS)
43 device for determining dot density
44 laser micrometer
45 third motor
46 measuring row
47 measuring strip
48 multiple measuring rows
50 printing area
51 non-printing area
52 enveloping radius/envelope
53 print dot on the printing plate
54 dot just barely printing on the printing plate
55 non-printing dot on the printing plate
56 lowest point
57 radial distance
58 marking device
59 measuring field for measuring shore hardness
60 motor
62 device for scanning the ID
100 rotary printing press
100*a* drive side/DS
100*b* operator side/OS
102 web of printing substrate
103 printing units
104 motors
105 printing cylinder
105*a* sleeve
106 impression cylinder
107 anilox roller
108 printing forme/stereotype
109 printed image
110 frame
111 cylinder journal
112 bearing
113 bearing bracket or post, bearing support
114 guide
115 control device
116 actuating drive
117 electric motor or servomotor
118 master
119 encoder
120 spindle
121 further printing cylinder
122 actuating drive

123 digital computer
124 disturbances
125 further disturbances
126 output signals
127 first printing speed
128 second printing speed
129 dryer
130 ID
300 sleeve
301 flexographic printing forme
302 further flexographic printing forme
303 area of high dot density
304 area of low dot density
305 gap
306 gap, non-printing area
307 gap, non-printing area
307*a* printing area
308 gap between flexographic printing formes
309 gap
310 register mark
311 register mark
312 color measuring field
313 color measuring field
314 control strip
315 control strip
316 ID
317 memory
318 error mark
400 camera
401 computer
402 sensor
403 computer
404 motor
405 direction of movement
410 image
R radial distance
D diameter
x direction (circumferential direction)
y direction (axial direction)

The invention claimed is:

1. A method of operating a flexographic printing press, the method comprising:

providing the flexographic printing press including a printing cylinder carrying a sleeve with at least one flexographic printing forme or a flexographic printing cylinder and an impression cylinder;

using a motor of the flexographic printing press for adjusting a contact pressure between the printing cylinder or the flexographic printing cylinder and the impression cylinder;

measuring a dot density of the flexographic printing forme in a contact-free manner in a measuring operation in a measuring device before a printing operation;

using a camera and a reference object in the measuring operation;

the reference object extending in a direction parallel to an axis of a cylinder of the measuring device carrying the sleeve during the measuring operation, the reference object creating a reference line for computationally calculating the dot density;

carrying out the adjustment in an automated manner as a function of the dot density of the flexographic printing forme, the dot density being a location-dependent density of printing elevations of the flexographic printing forme, or data computationally derived from the location-dependent density; and carrying out the printing operation with the adjusted contact pressure.

2. The method according to claim 1, which further comprises carrying out adjustments dynamically during a printing operation as a function of a rotary speed of the printing cylinder.

3. The method according to claim 1, which further comprises scanning an entire image of the flexographic printing forme in a measuring operation.

4. The method according to claim 3, which further comprises mounting at least one flexographic printing forme or at least two flexographic printing formes to the sleeve and recording the at least one flexographic printing forme or the at least two flexographic printing formes in the measuring operation.

5. The method according to claim 1, which further comprises calculating adjustment values.

6. The method according to claim 5, which further comprises transmitting the adjustment values to a control of the motor for adjusting the contact pressure.

7. The method according to claim 5, which further comprises carrying out the calculation of the adjustment values as a function of the dot density of the flexographic printing forme.

8. The method according to claim 1, which further comprises providing the flexographic printing press with an anilox roller for inking the flexographic printing forme.

9. The method according to claim 8, which further comprises marking the anilox roller with an ID and identifying the ID in the flexographic printing press.

10. The method according to claim 9, which further comprises using the motor to adjust a further contact pressure being a contact pressure between the printing cylinder and the anilox roller.

11. A system, comprising:

a flexographic printing press including at least one flexographic printing unit for printing on a printing substrate using flexographic printing ink, said at least one flexographic printing unit including a printing cylinder carrying a sleeve with at least one flexographic printing forme or a flexographic printing cylinder, an impression cylinder, and an anilox roller;

a measuring device for measuring a dot density of the flexographic printing forme in a contact-free manner in a measuring operation before a printing operation, said measuring device including a cylinder having an axis, a camera and a reference object to be used in the measuring operation, said measuring device transmitting the dot density or data derived from the dot density to the flexographic printing press;

said measuring device including at least one actuating motor for an automated adjustment of a contact pressure between said printing cylinder or flexographic printing cylinder and said impression cylinder for carrying out a printing operation with an adjusted contact pressure, said at least one said actuating motor being computationally controlled based on the dot density of the flexographic printing forme or data derived from the dot density to provide the contact pressure between said printing cylinder and said impression cylinder with a predefined value or a predefined range of values, the dot density being a location-dependent density of printing elevations of the flexographic printing forme, or data computationally derived from the location-dependent density; and said reference object extending in a direction parallel to said axis of said cylinder of said measuring device carrying said sleeve during the measuring operation, said reference object creating a reference line for computationally calculating the dot density.

12. The system according to claim 11, which further comprises a machine-readable ID marking at least one of said flexographic printing forme or said sleeve.

13. The system according to claim 12, wherein said ID is an unambiguous identifier of said sleeve.

14. The system according to claim 13, wherein said ID includes at least one of multiple digits or letters or special characters.

15. The system according to claim 12, wherein said measuring device indirectly transmits the dot density or data derived from the dot density to said flexographic printing press together with said ID by buffering and accessing the dot density or the data derived from the dot density by said flexographic printing press for a printing operation using at least one of said flexographic printing forme or said sleeve.

16. The system according to claim 11, wherein said anilox roller is one of a plurality of anilox rollers having at least one of different screens or screen widths, said flexographic printing press being operated, in a printing operation with said flexographic printing forme, with an anilox roller having been computationally selected from among said plurality of anilox rollers based on the dot density of said flexographic printing forme or data derived from the dot density.

* * * * *